US011085204B2

(12) United States Patent
Ichinose

(10) Patent No.: US 11,085,204 B2
(45) Date of Patent: Aug. 10, 2021

(54) AUTOMOBILE DOOR LOCKING DEVICE

(71) Applicant: MITSUI KINZOKU ACT CORPORATION, Yokohama (JP)

(72) Inventor: Mikio Ichinose, Yokohama (JP)

(73) Assignee: MITSUI KINZOKU ACT CORPORATION, Yokohama (JP)

( * ) Notice: Subject to any disclaimer, the term of this patent is extended or adjusted under 35 U.S.C. 154(b) by 535 days.

(21) Appl. No.: 15/779,019

(22) PCT Filed: Nov. 26, 2015

(86) PCT No.: PCT/JP2015/083260
§ 371 (c)(1),
(2) Date: May 24, 2018

(87) PCT Pub. No.: WO2017/090160
PCT Pub. Date: Jun. 1, 2017

(65) Prior Publication Data

US 2018/0355636 A1 Dec. 13, 2018

(51) Int. Cl.
*E05B 49/00* (2006.01)
*E05B 81/16* (2014.01)
(Continued)

(52) U.S. Cl.
CPC ..... *E05B 49/004* (2013.01); *E05B 47/0012* (2013.01); *E05B 77/22* (2013.01);
(Continued)

(58) Field of Classification Search
CPC ..... E05B 81/04; E05B 81/14; E05B 81/16; E05B 81/76; E05B 87/77; E05B 81/64;
(Continued)

(56) References Cited

U.S. PATENT DOCUMENTS 7,330,113 B1 2/2008 Decosey
8,022,808 B2 * 9/2011 Kurpinski ..... B60R 25/246 340/5.61
(Continued)

FOREIGN PATENT DOCUMENTS

CN 1253606 A 5/2000
CN 102011527 A 4/2011
(Continued)

OTHER PUBLICATIONS

CN Office Action issued in the corresponding Chinese Patent Application Ser. No. 201580084840.3.
(Continued)

*Primary Examiner* — Kristina R Fulton
*Assistant Examiner* — Yahya I Sidky
(74) *Attorney, Agent, or Firm* — Foley & Lardner LLP

(57) ABSTRACT

A motor vehicle door lock apparatus includes a meshing mechanism configured to mesh with a striker, an outside operation switch, an inside handle, a locking and unlocking mechanism configured to be selectively switched to an unlocking state and a locking state that cannot be released based on a door opening operation of the inside handle, a control unit configured to authenticate a transmitter signal and, when the transmitter is situated outside a vehicle, to enable operation of the outside operation switch when authenticated and to disable operation of the outside operation switch when not authenticated and an electric releasing mechanism to release a meshing of the meshing mechanism by the control unit driving a releasing motor to activate operation of the outside operation switch when the control unit authenticates the transmitter outside the vehicle, regardless of the locking and unlocking mechanism staying in the unlocking or the locking state.

10 Claims, 21 Drawing Sheets

(51) Int. Cl.

| | |
|---|---|
| ***E05B 77/32*** | (2014.01) |
| ***E05B 77/22*** | (2014.01) |
| ***E05B 47/00*** | (2006.01) |
| *E05B 81/76* | (2014.01) |
| *E05B 81/06* | (2014.01) |
| *E05B 85/12* | (2014.01) |
| *E05B 81/42* | (2014.01) |
| *E05B 81/66* | (2014.01) |

(52) U.S. Cl.
CPC ..... *E05B 77/32* (2013.01); *E05B 81/16* (2013.01); *E05B 81/06* (2013.01); *E05B 81/42* (2013.01); *E05B 81/66* (2013.01); *E05B 81/76* (2013.01); *E05B 85/12* (2013.01)

(58) Field of Classification Search
CPC .... E05B 49/004; E05B 47/0012; E05B 77/22; E05B 81/06; E05B 81/42; E05B 81/66; E05B 85/12
See application file for complete search history.

(56) References Cited

U.S. PATENT DOCUMENTS

| | | | | |
|---|---|---|---|---|
| 8,474,888 | B2 * | 7/2013 | Tomaszewski | E05B 77/30 292/201 |
| 2002/0089188 | A1 * | 7/2002 | Edgar | E05B 81/04 292/216 |
| 2008/0136195 | A1 * | 6/2008 | Ooe | E05B 85/01 292/198 |
| 2011/0154740 | A1 | 6/2011 | Matsumoto et al. | |
| 2011/0160966 | A1 | 6/2011 | Witte | |
| 2012/0182122 | A1 | 7/2012 | Nishiguchi | |
| 2014/0195109 | A1 * | 7/2014 | Lange | E05B 83/36 701/36 |
| 2015/0330112 | A1 * | 11/2015 | Van Wiemeersch | E05B 81/76 292/201 |

FOREIGN PATENT DOCUMENTS

| | | | |
|---|---|---|---|
| CN | 102041931 | A | 5/2011 |
| CN | 102076922 | A | 5/2011 |
| CN | 102587738 | A | 7/2012 |
| CN | 104442702 | A | 3/2015 |
| EP | 2 312 097 | A2 | 4/2011 |
| JP | 2009-220924 | A | 10/2009 |
| JP | 2010-133099 | A | 6/2010 |
| JP | 2011-132771 | A | 7/2011 |
| JP | 2015-063876 | A | 4/2015 |
| JP | 2015-094067 | A | 5/2015 |

OTHER PUBLICATIONS

International Search Report for PCT/JP2015/083260 dated Feb. 16, 2016.
Written Opinion of the International Search Authority for PCT/JP2015/083260 dated Feb. 16, 2016.

* cited by examiner

[FIG. 1]
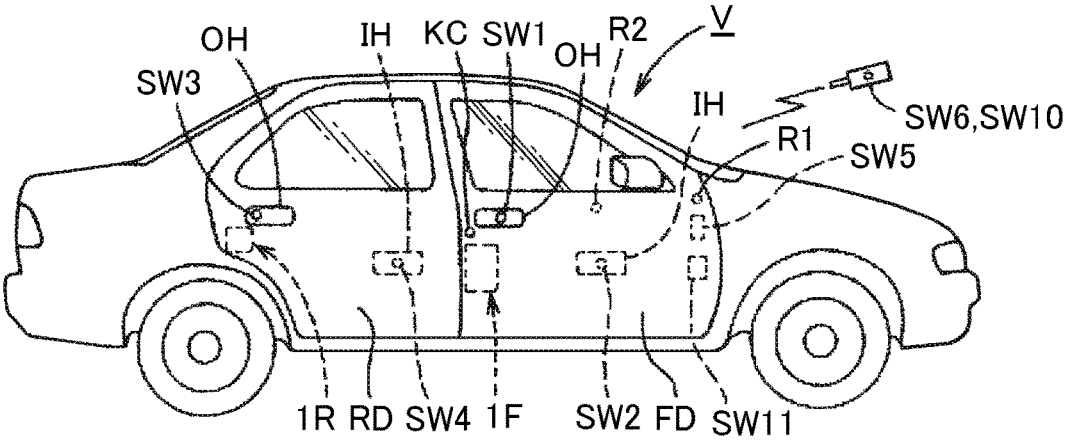

[FIG. 2]
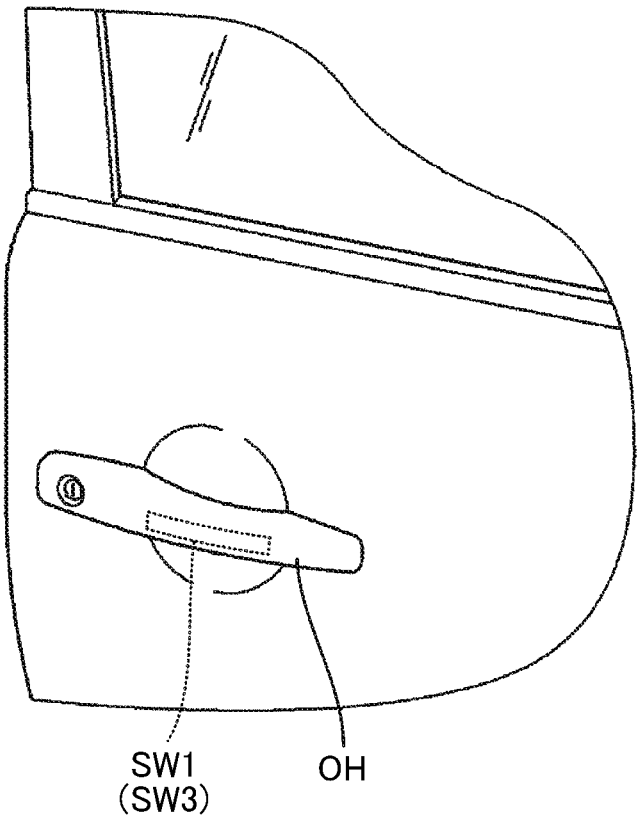

[FIG. 3]
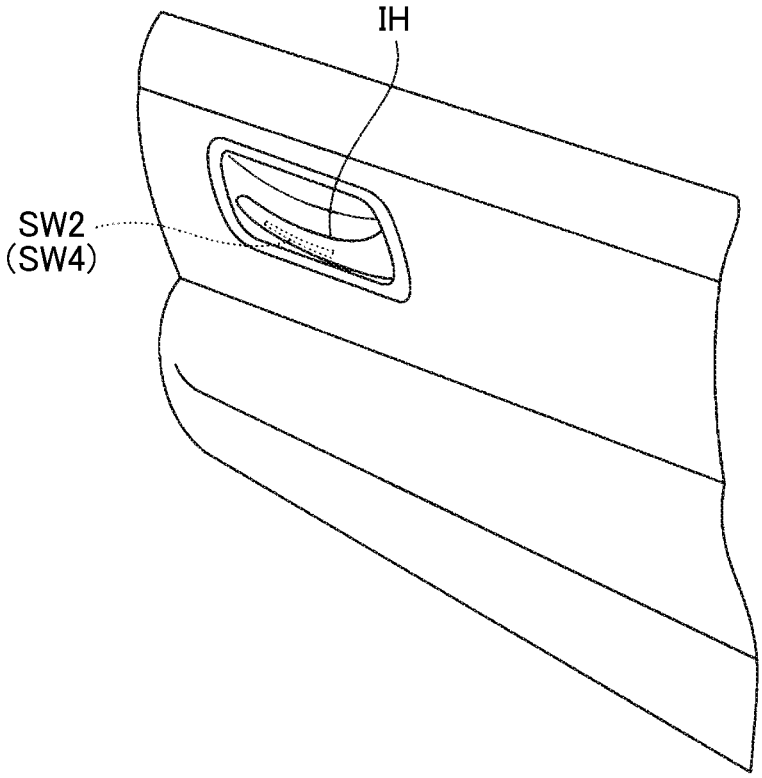

[FIG. 4]
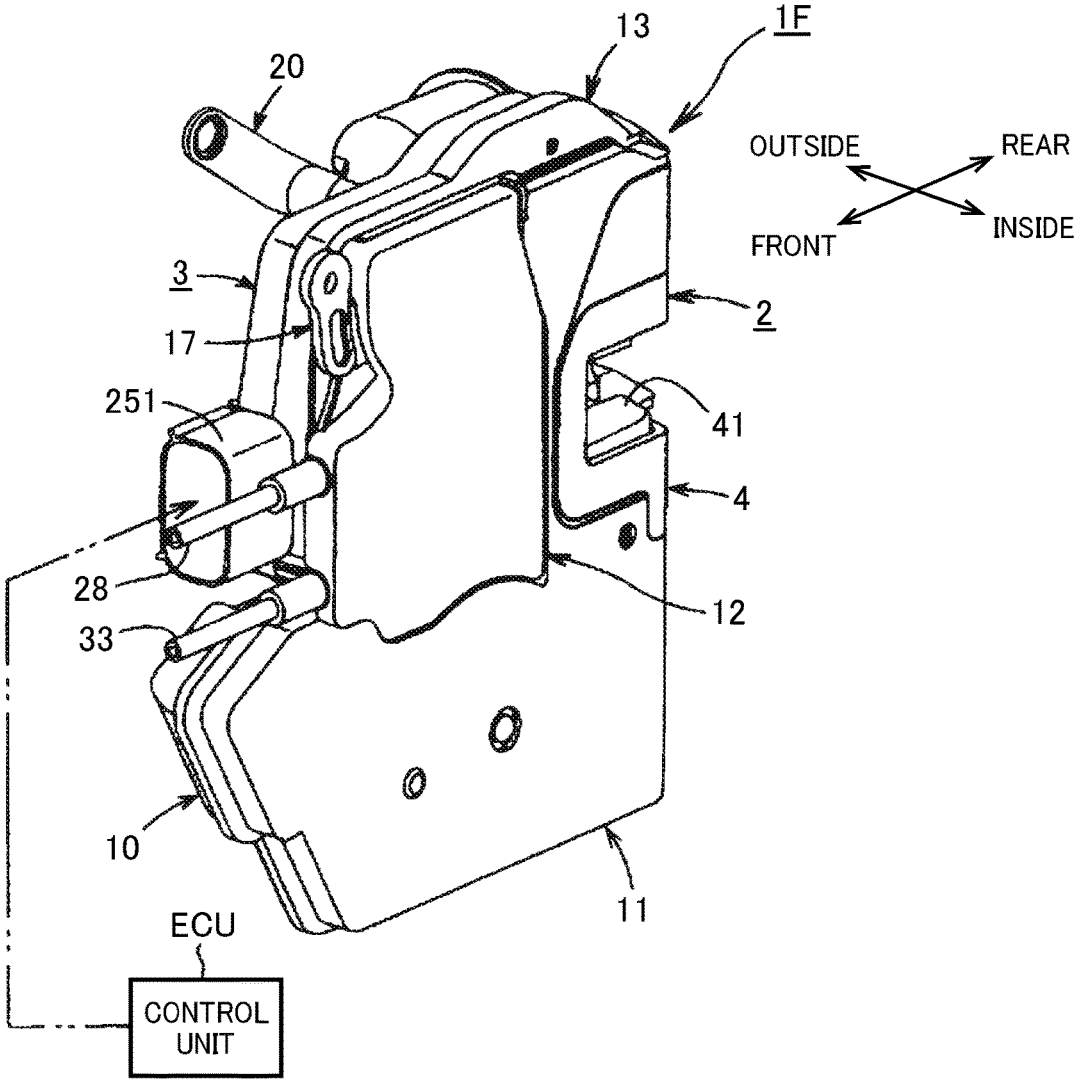

[FIG. 5]
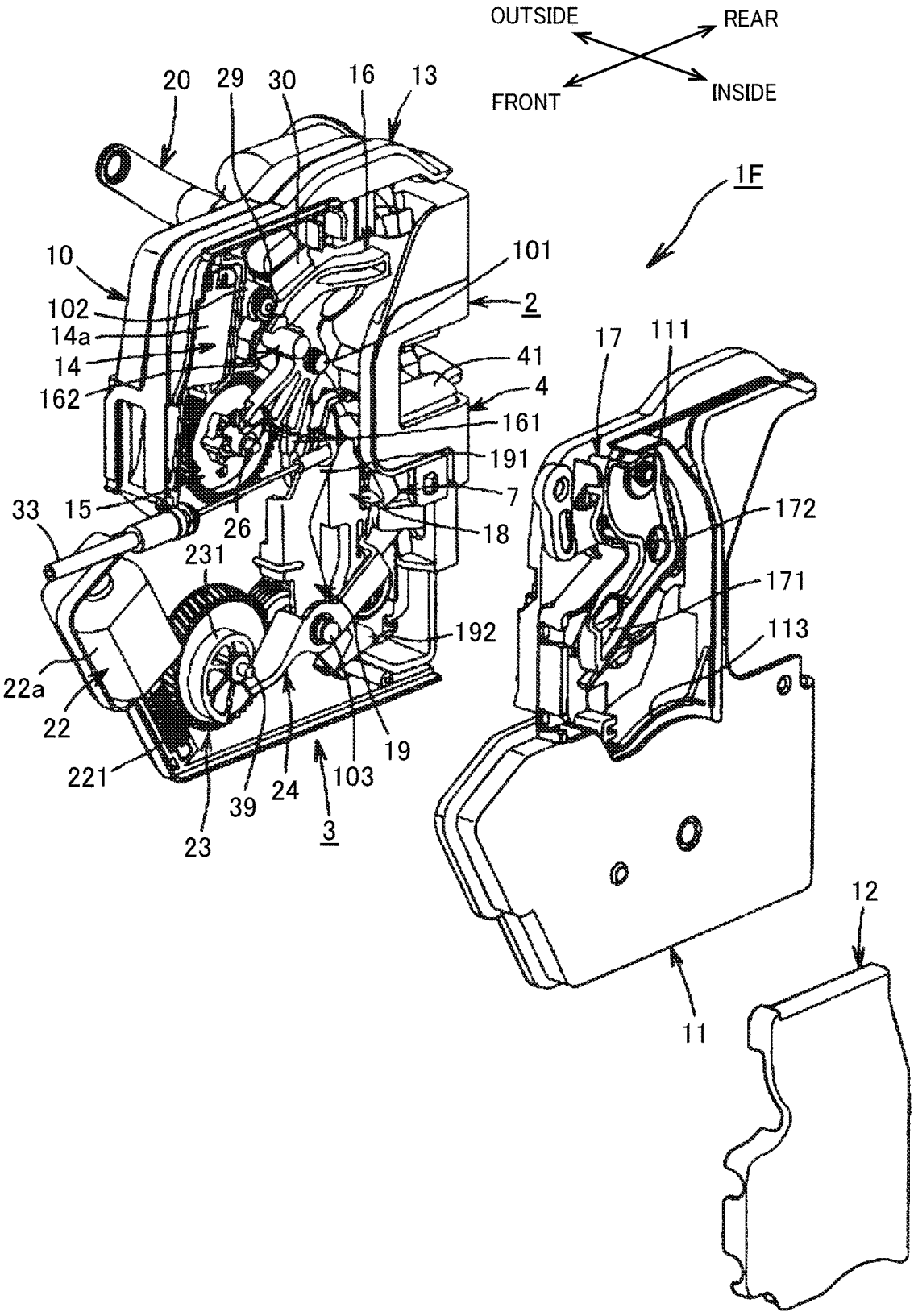

[FIG. 6]
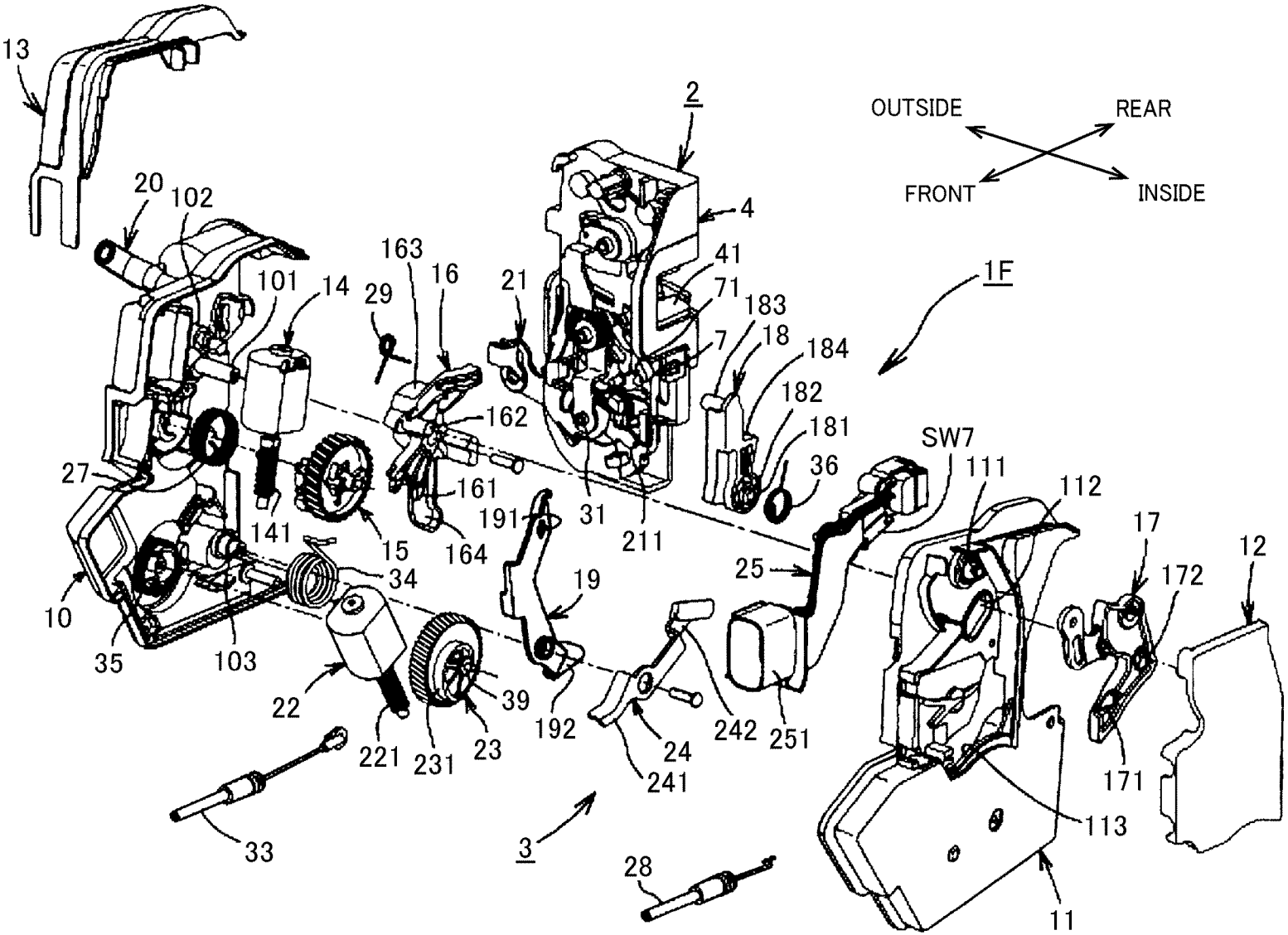

[FIG. 7]
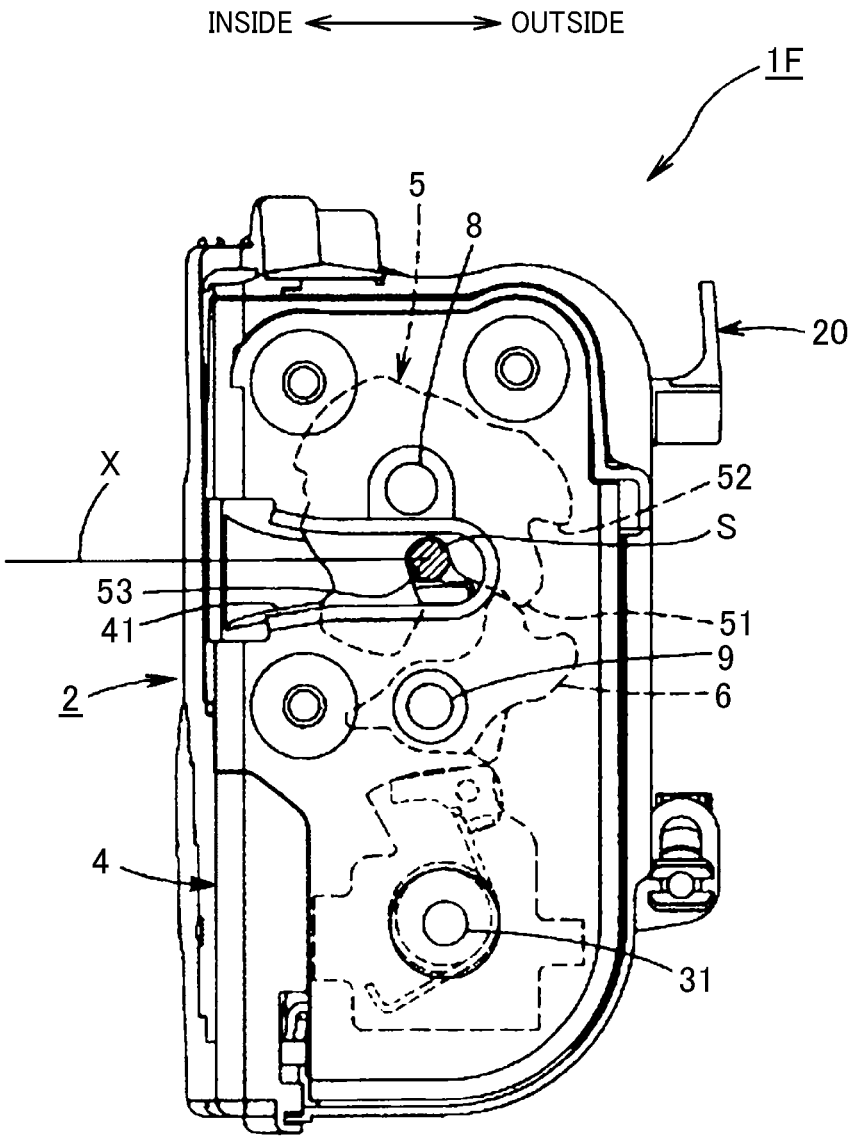

[FIG. 8]
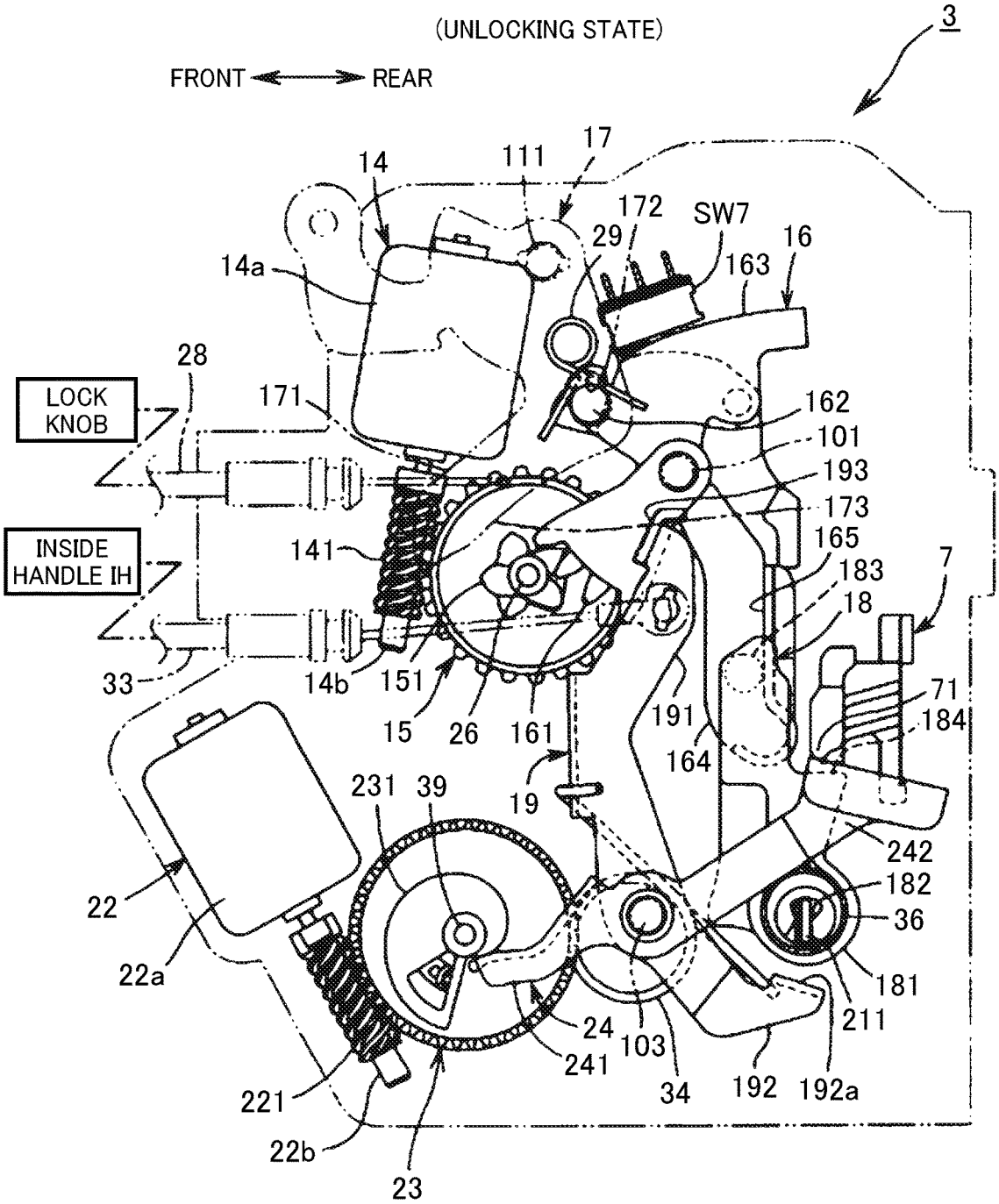

[FIG. 9]
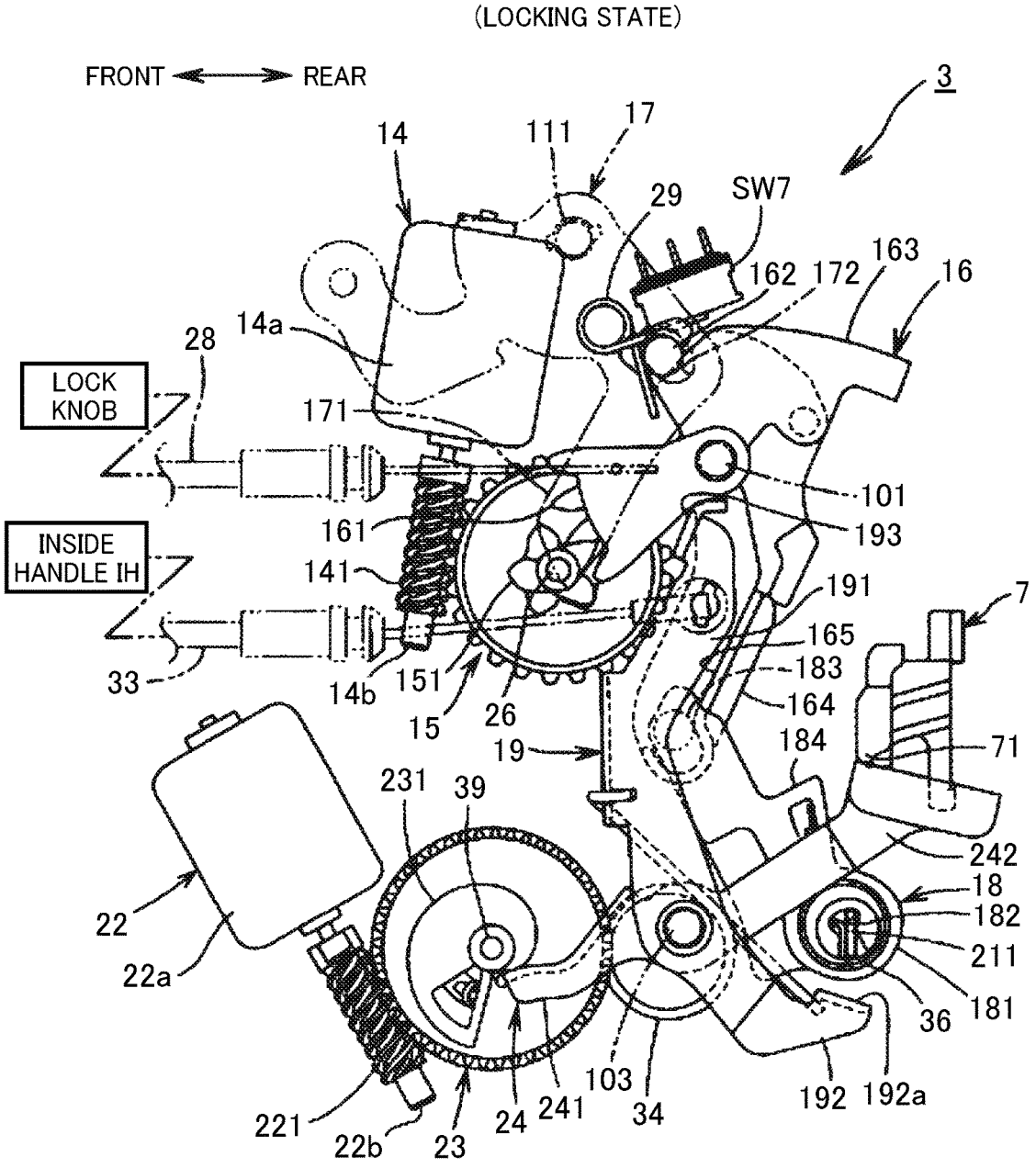

[FIG. 10]
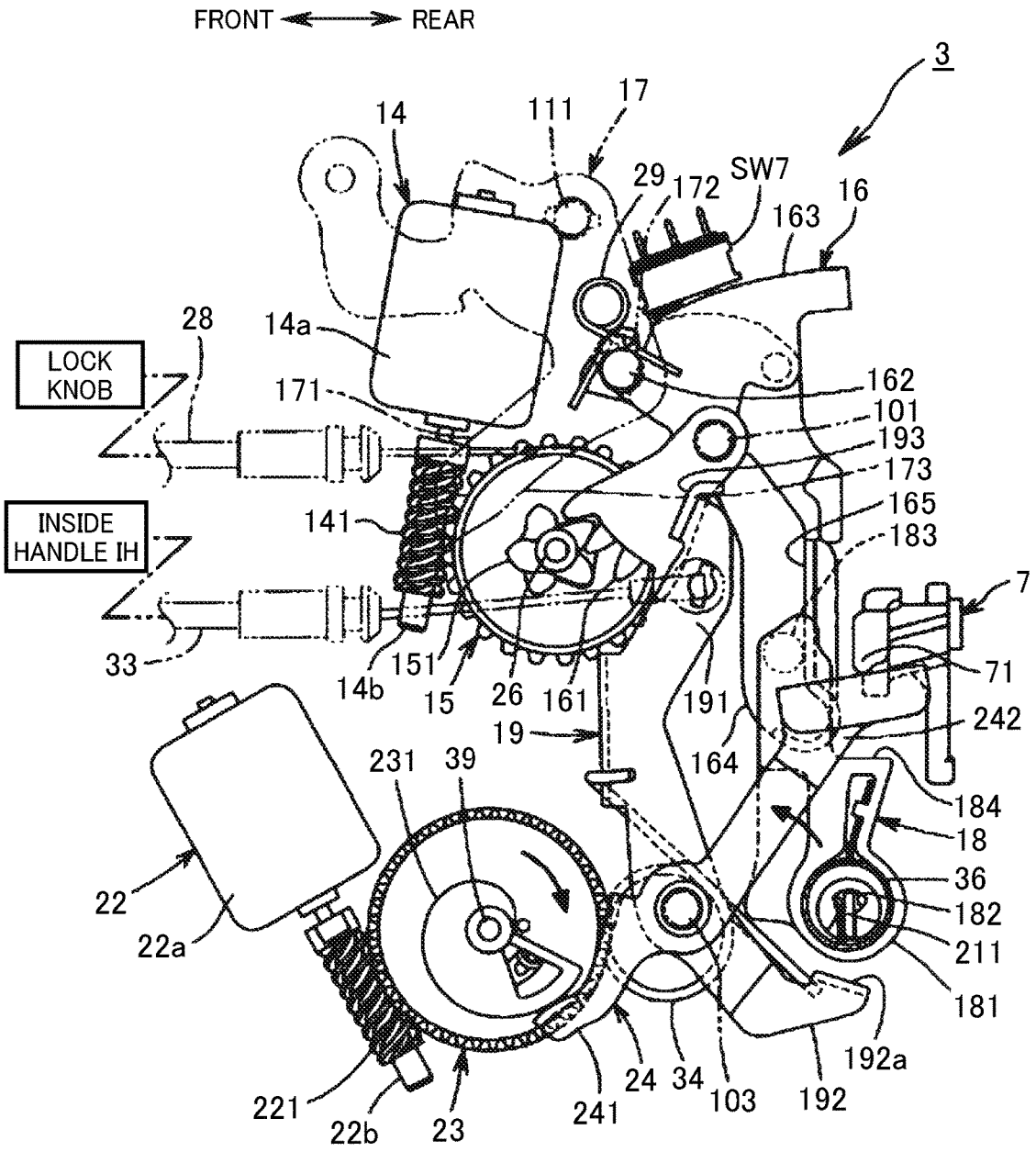

[FIG. 11]
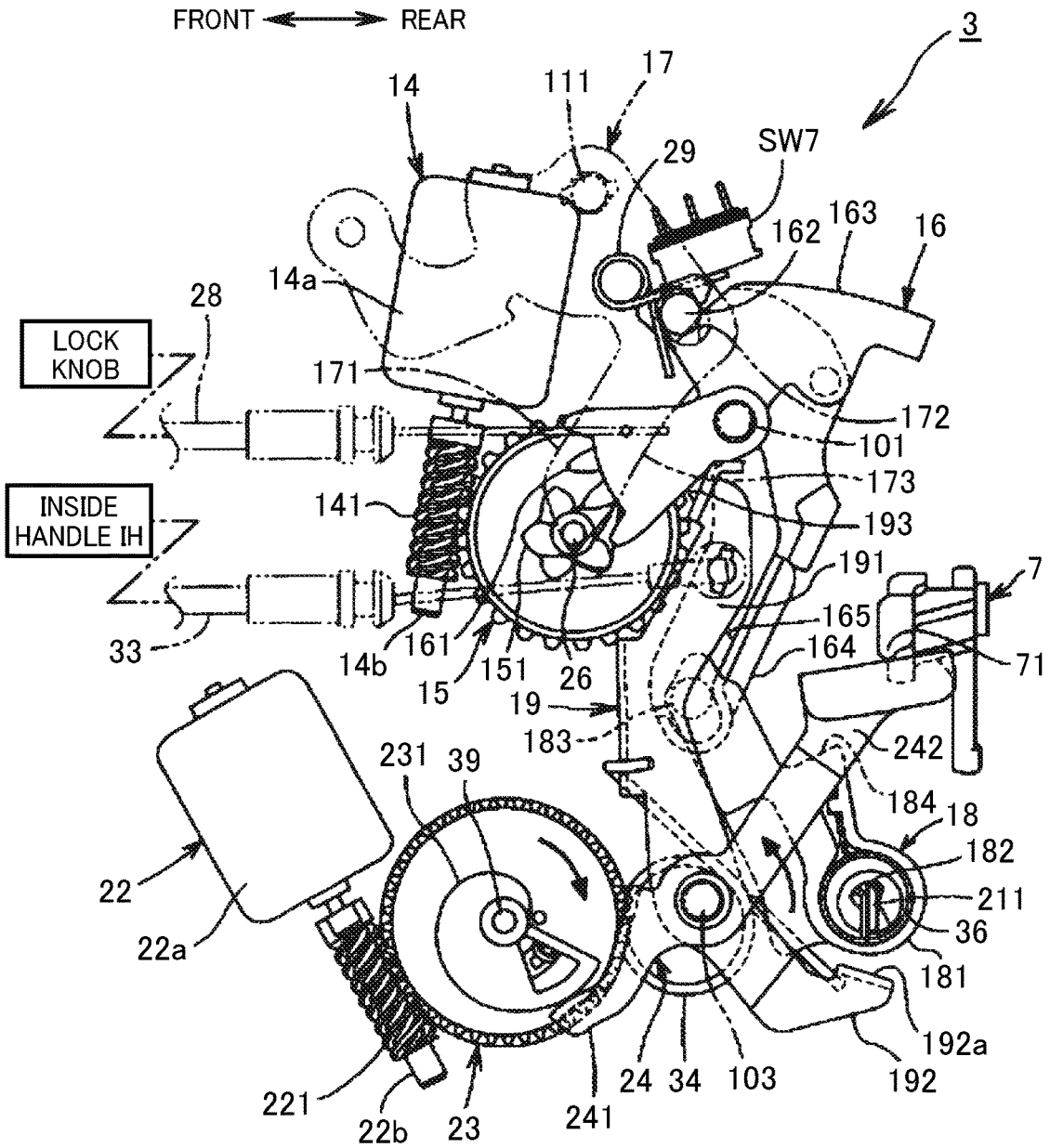

[FIG. 12]
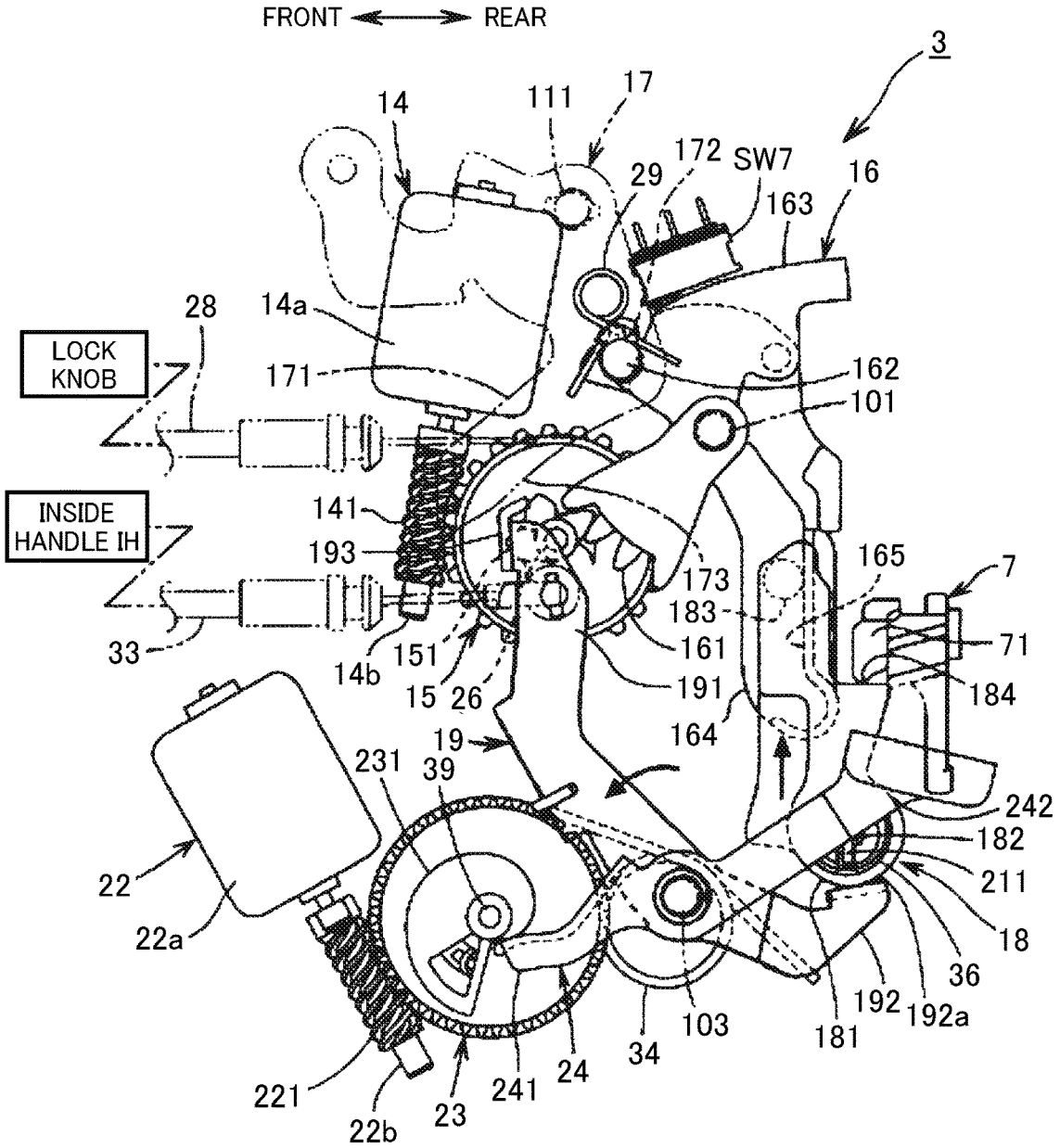

[FIG. 13]
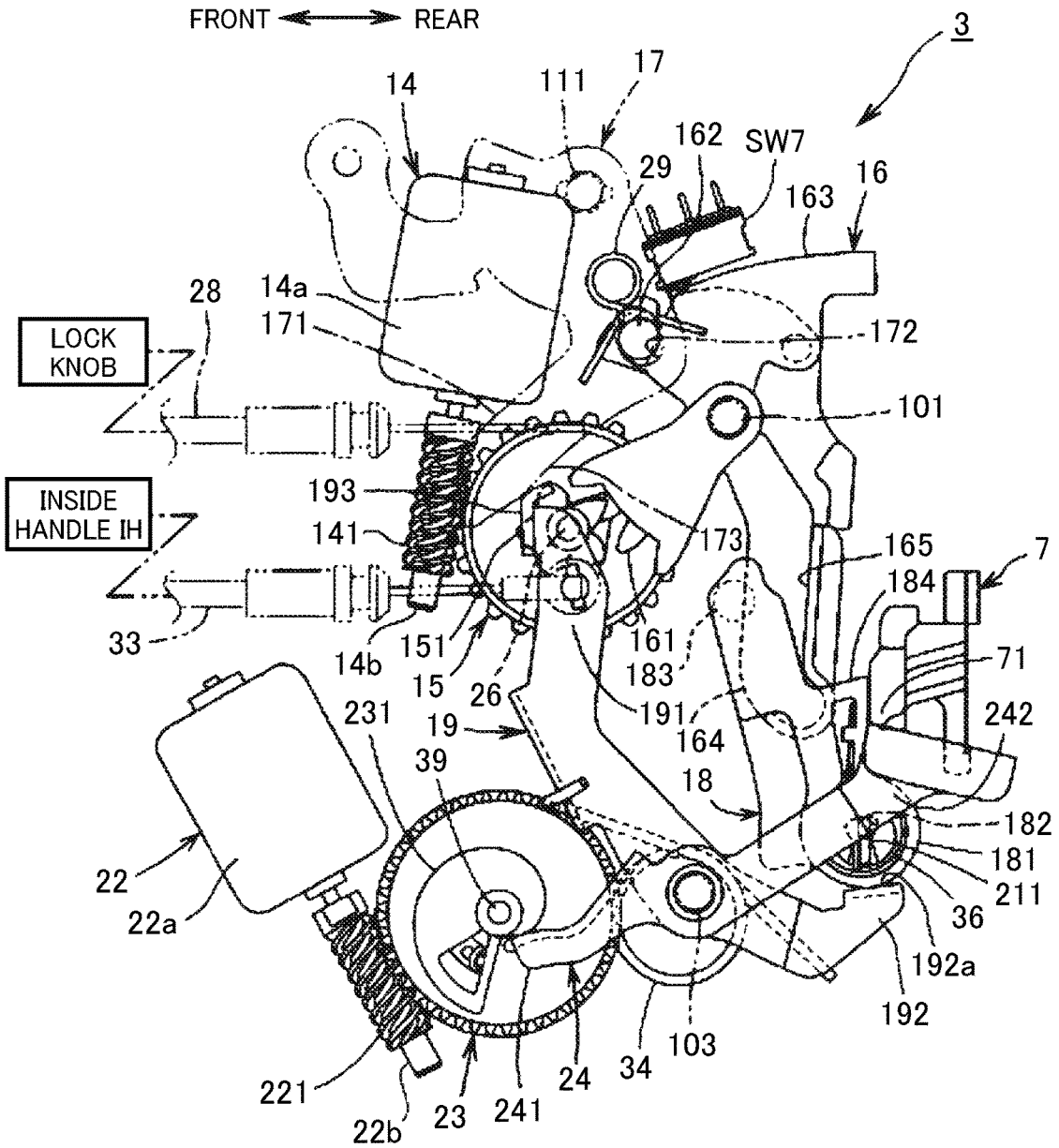

[FIG. 14]
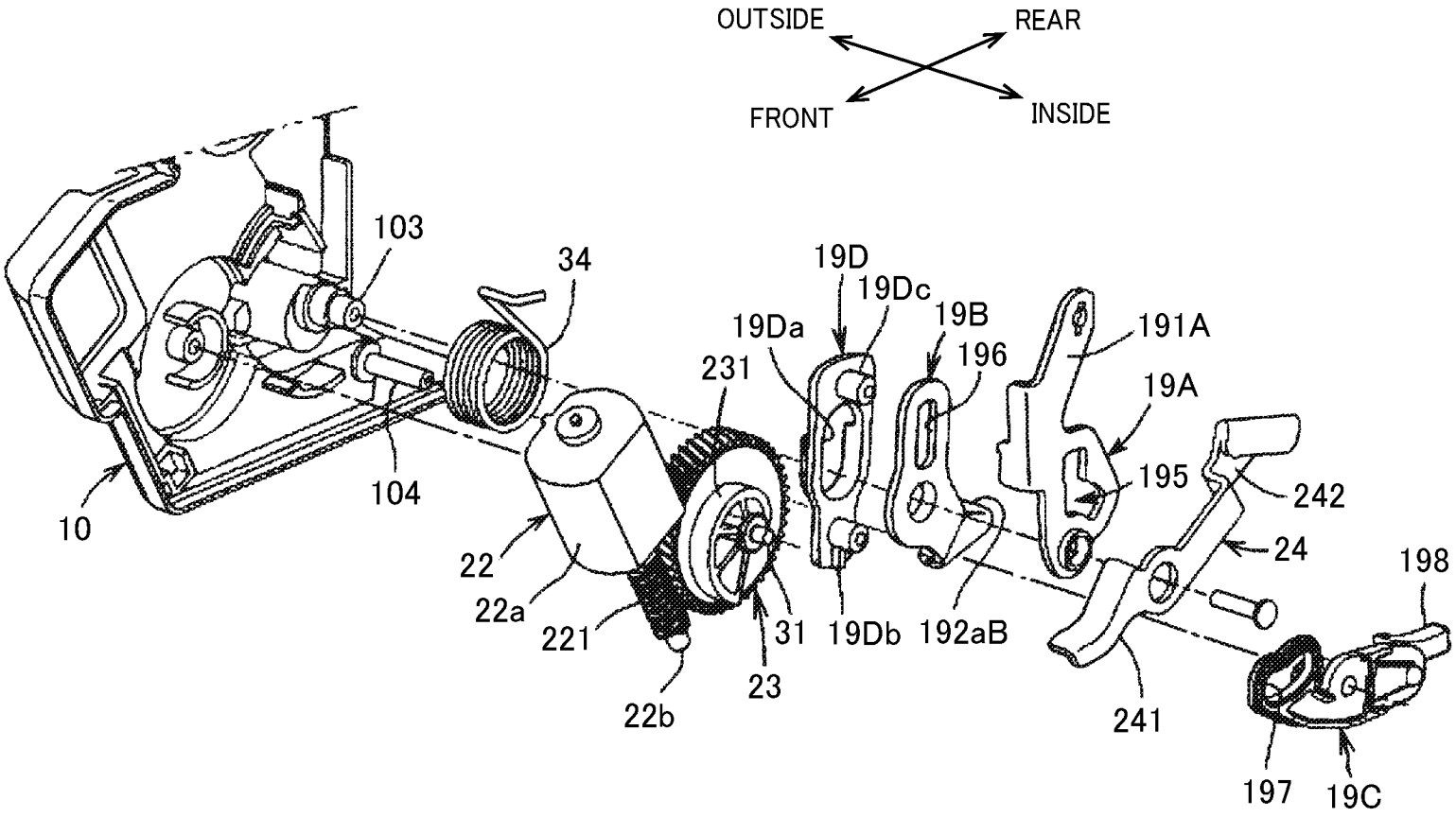

[FIG. 15]
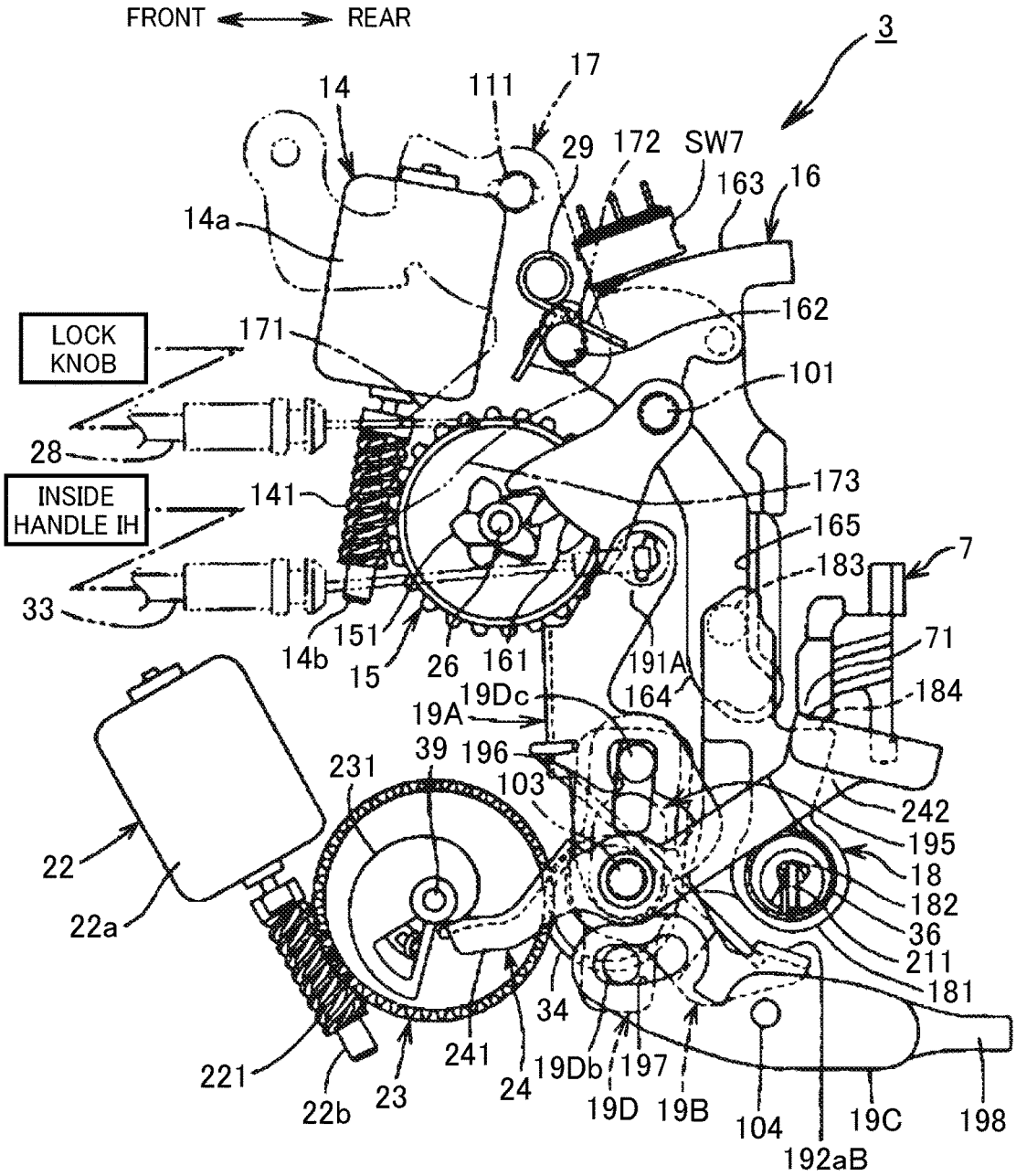

[FIG. 16]
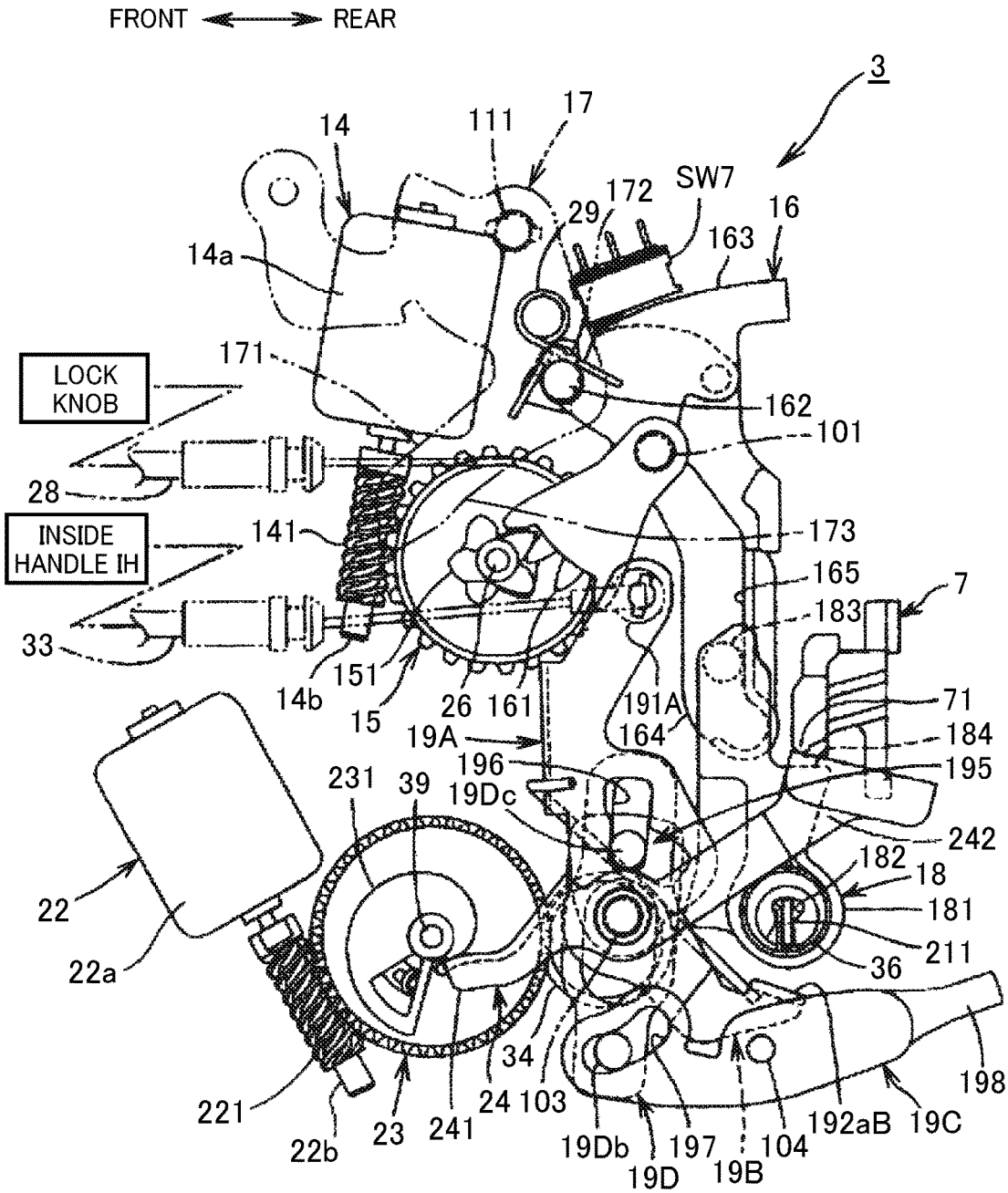

[FIG. 17]
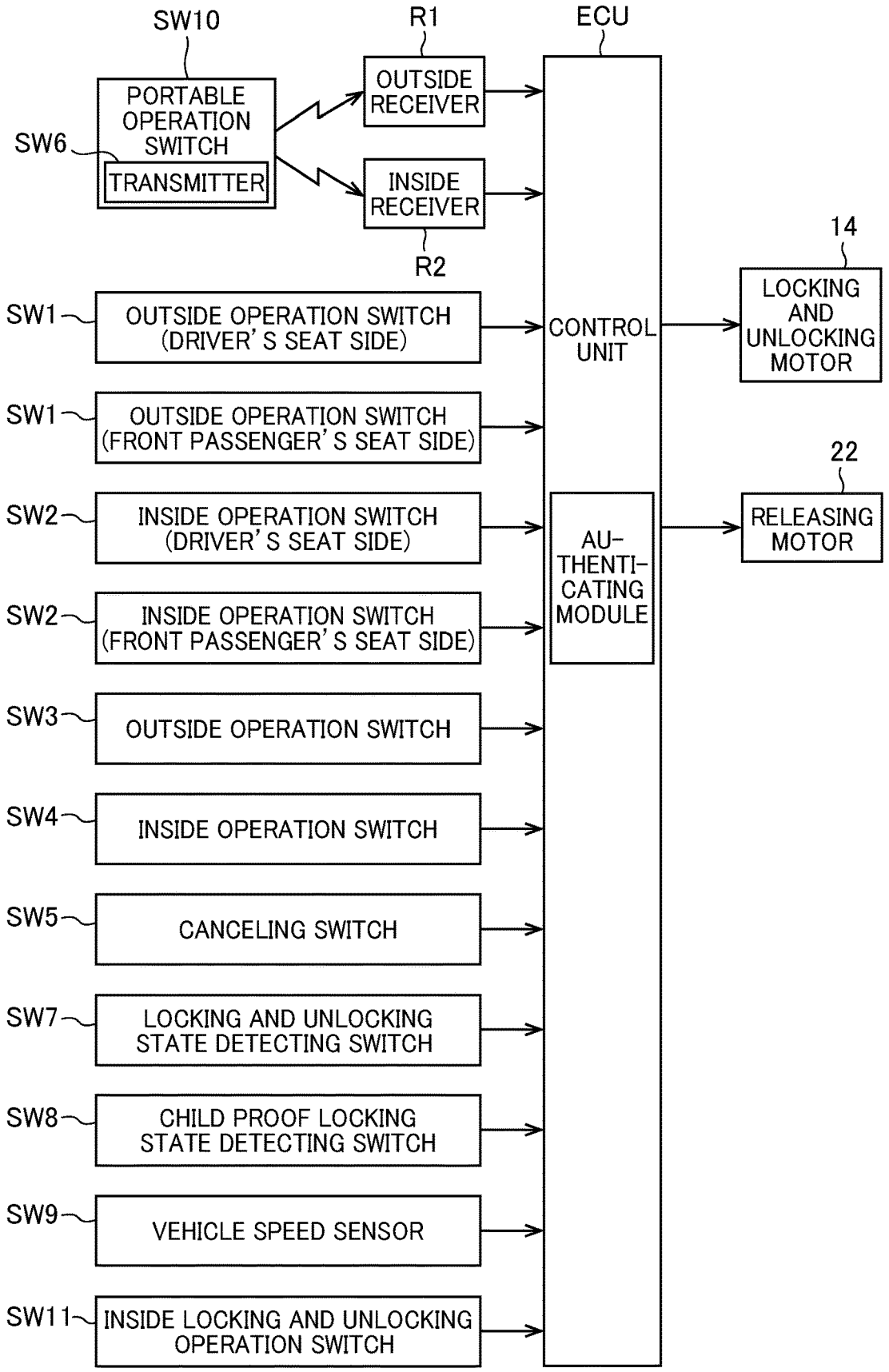

[FIG. 18]
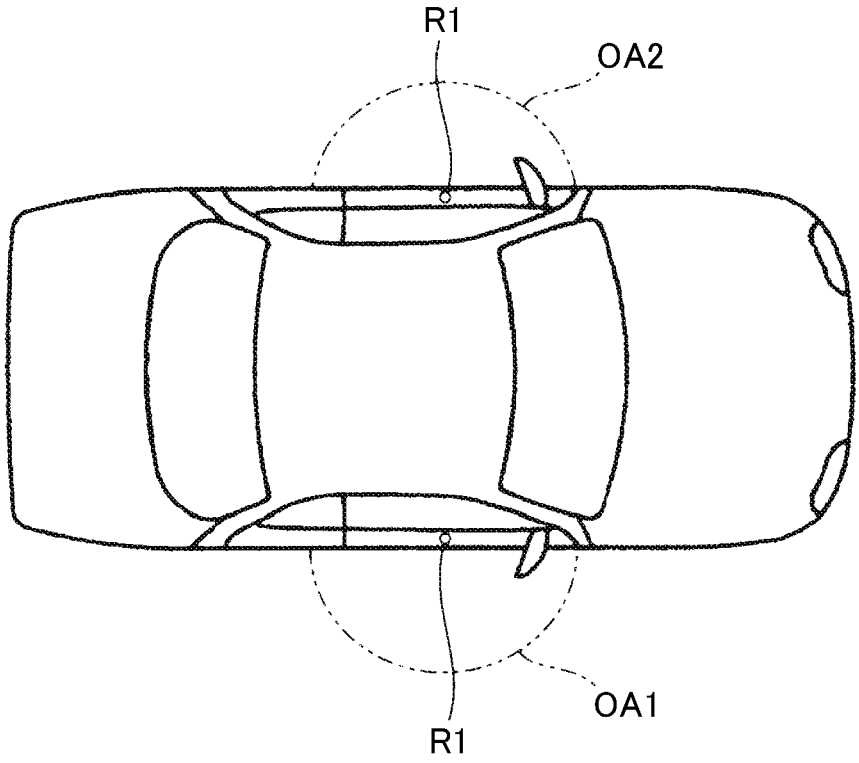

[FIG. 19]
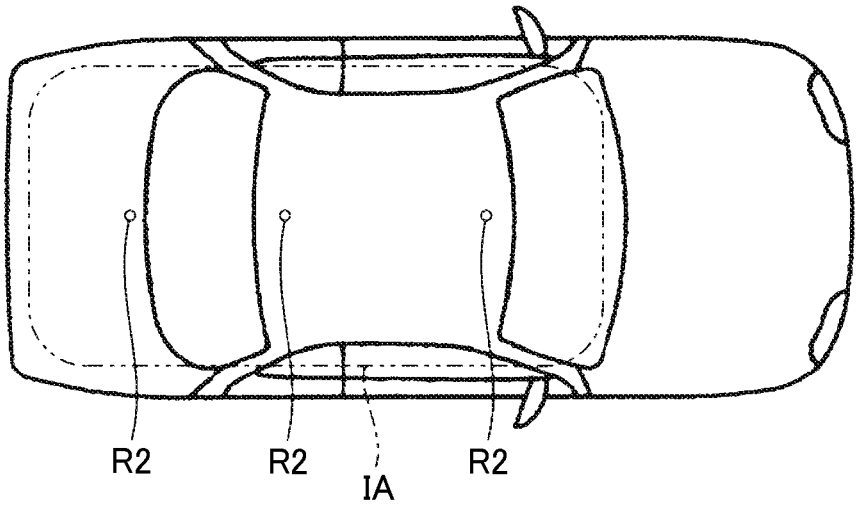

[FIG. 20]

○ : ENABLED
× : DISABLED

| | | | | | | | | | | | | | |
|---|---|---|---|---|---|---|---|---|---|---|---|---|---|
| PORTABLE OPERATION SWITCH SW10 | ○ | ○ | ○ | ○ | × | × | × | × | ○ | ○ | ○ | ○ | × |
| OUTSIDE OPERATION SWITCH (DRIVER'S SEAT SIDE) SW1 | ○ | ○ | ○ | ○ | × | × | × | × | ○ | × | ○ | × | × |
| OUTSIDE OPERATION SWITCH (FRONT PASSENGER'S SEAT SIDE) SW1 | ○ | × | ○ | × | × | × | × | × | ○ | × | ○ | × | × |
| INSIDE OPERATION SWITCH (DRIVER'S SEAT SIDE) SW2 | ○ | ○ | ○ | ○ | × | ○ | × | × | ○ | ○ | ○ | ○ | × |
| INSIDE OPERATION SWITCH (FRONT PASSENGER'S SEAT SIDE) SW2 | ○ | × | × | × | × | ○ | × | × | ○ | × | × | × | × |
| TRANSMITTER SW6 | AUTHENTICATED (OUTSIDE) | | | | | NOT-AUTHENTICATED | | | AUTHENTICATED (INSIDE) | | | | |
| CANCELING SWITCH SW5 | UNSET | | CANCEL | | UNSET/CANCEL | UNSET | CANCEL | UNSET/CANCEL | UNSET | | CANCEL | | UNSET/CANCEL |
| LOCKING AND UNLOCKING STATE DETECTING SWITCH SW7 | UNLOCK | LOCK | UNLOCK | LOCK | UNLOCK/LOCK | UNLOCK/LOCK | | | UNLOCK | LOCK | UNLOCK | LOCK | UNLOCK/LOCK |
| VEHICLE SPEED SENSOR SW9 | HALT | | | | RUNNING | HALT | | RUNNING | HALT | | | | RUNNING |

[FIG. 21]

○ : ENABLED
× : DISABLED

| | | | | | | | | | | | | | | | | | | |
|---|---|---|---|---|---|---|---|---|---|---|---|---|---|---|---|---|---|---|
| PORTABLE OPERATION SWITCH SW10 | ○ | ○ | ○ | ○ | ○ | ○ | × | × | × | × | × | ○ | ○ | ○ | ○ | ○ | ○ | × |
| OUTSIDE OPERATION SWITCH SW3 | ○ | × | ○ | × | ○ | × | × | × | × | × | × | ○ | × | ○ | × | ○ | × | × |
| INSIDE OPERATION SWITCH SW4 | ○ | × | × | × | × | × | × | ○ | × | × | × | ○ | × | × | × | × | × | × |
| TRANSMITTER SW6 | AUTHENTICATED (OUTSIDE) | | | | | | | NOT-AUTHENTICATED | | | | AUTHENTICATED (INSIDE) | | | | | | |
| CANCELING SWITCH SW5 | UNSET | | | | CANCEL | | UNSET/CANCEL | UNSET | | CANCEL | UNSET/CANCEL | UNSET | | | | CANCEL | | UNSET/CANCEL |
| LOCKING AND UNLOCKING STATE DETECTING SWITCH SW7 | UNLOCK | LOCK | UNLOCK | LOCK | UNLOCK | LOCK | UNLOCK/LOCK | UNLOCK/LOCK | | | | UNLOCK | LOCK | UNLOCK | LOCK | UNLOCK | LOCK | UNLOCK/LOCK |
| CHILD PROOF LOCKING STATE DETECTING SWITCH SW8 | UNLOCK | | LOCK | | UNLOCK/LOCK | | | UNLOCK | LOCK | UNLOCK/LOCK | | UNLOCK | | LOCK | | UNLOCK/LOCK | | |
| VEHICLE SPEED SENSOR SW9 | HALT | | | | | | RUNNING | HALT | | | RUNNING | HALT | | | | | | RUNNING |

AUTOMOBILE DOOR LOCKING DEVICE

CROSS-REFERENCE TO RELATED APPLICATION

This is a U.S. national stage application claiming the benefit of International Patent Application No. PCT/JP2015/083260 filed Nov. 26, 2015, the entire content of which is incorporated herein by reference.

TECHNICAL FIELD

The present invention relates to a motor vehicle door lock apparatus.

BACKGROUND ART

A motor vehicle door lock apparatus described in PTL 1 authenticates a portable device that a user carries by transmitting and receiving signals between the portable device and itself and executes a door unlocking process when a hand of the user moves nearer to a door of the motor vehicle with the portable device authenticated on the understanding that the user intends to unlock the door.

CITATION LIST

Patent Literature

PTL 1: JP-A-2015-63876

SUMMARY OF INVENTION

Technical Problem

Although PTL 1 describes nothing about a door opening operation that would be performed after the unlocking process has been executed, in general, a motor vehicle door lock apparatus includes a meshing mechanism made up of a latch configured to mesh with a striker and a ratchet capable of engaging with the latch. Then, in an unlocked state, operating an outside handle provided on an outer side of a door or an inside handle provided on an inner side of the door releases an engagement between the ratchet and the latch, and this can release a meshing engagement between the latch and the striker, thereby allowing the door to be opened. Then, switching the door between a locked state and an unlocked state is executed by a locking and unlocking mechanism that can selectively relay the operation of the outside handle or the inside handle and cut off the relay of the operation of the door handle.

In the motor vehicle door lock apparatus described in PTL 1, there may occur a case where the operation of the handle is inputted into the locking and unlocking mechanism in an overlapping fashion while the locking and unlocking mechanism is being switched to execute the unlocking process. As this occurs, this causes a problem with switching the locking and unlocking mechanism, leading to a so-called panic state where even though the door handle is operated, the engagement of the ratchet with the latch is left unreleased, and hence, the door cannot be opened.

The invention has been made in view of the situations described above, and an object thereof is to provide a motor vehicle door lock apparatus that can prevent the occurrence of such a panic state.

Solution to Problem

A motor vehicle door lock apparatus according to one illustrative aspect of the invention comprises: a meshing mechanism configured to mesh with a striker to hold a door in a closed state; an outside electric operation element provided on an outer side of the door; an inside mechanical operation element provided on an inner side of the door; a locking and unlocking mechanism configured to be selectively switched to: an unlocking state where a meshing of the meshing mechanism can be released based on a door opening operation of the inside mechanical operation element; and a locking state where a meshing of the meshing mechanism cannot be released; a control unit configured to authenticate a transmitter based on a signal emitted by the transmitter, wherein in a case where the transmitter is situated outside a vehicle, the control unit is configured to: enable an operation of the outside electric operation element when the transmitter is authenticated; and disable the operation of the outside electric operation element when the transmitter is not authenticated; and an electric releasing mechanism configured to release a meshing of the meshing mechanism by the control unit driving a releasing motor to activate a releasing operation based on the operation of the outside electric operation element when the control unit authenticates the transmitter outside the vehicle, regardless of the locking and unlocking mechanism being in either the unlocking state or the locking state.

Advantageous Effect of Invention

According to the invention, it is possible to provide the motor vehicle door lock apparatus that can prevent the occurrence of the panic state.

BRIEF DESCRIPTION OF DRAWINGS

FIG. 1 is a side view of a motor vehicle including a door lock apparatus according to the invention.

FIG. 2 is a perspective view of an outer side of a door.

FIG. 3 is a perspective view of an inner side of the door.

FIG. 4 is a perspective view of a door lock apparatus for a front side door.

FIG. 5 is a partially exploded perspective view of the front side door's door lock apparatus.

FIG. 6 is an exploded perspective view of the front side door's door lock apparatus.

FIG. 7 is a rear view of the front side door's door lock apparatus.

FIG. 8 is a side view of a main part of the front side door's door lock apparatus when a locking and unlocking mechanism thereof is in an unlocking state.

FIG. 9 is a side view of the main part of the front side door's door lock apparatus when the locking and unlocking mechanism is in a locking state.

FIG. 10 is a side view of the main part of the front side door's door lock apparatus when an electrical releasing operation is performed with the locking and unlocking mechanism in the unlocking state.

FIG. 11 is a side view of the main part of the front side door's door lock apparatus when the electrical releasing operation is performed with the locking and unlocking mechanism in the locking state.

FIG. 12 is a side view of the main part of the front side door's door lock apparatus when a manual releasing operation is performed with the locking and unlocking mechanism in the unlocking state.

FIG. 13 is a side view of the main part of the front side door's door lock apparatus when the manual releasing operation is performed with the locking and unlocking mechanism in the locking state.

FIG. 14 is an exploded perspective view of a main part of a door lock apparatus for a rear side door.

FIG. 15 is a side view of the main part of the rear side door's door lock apparatus when a locking and unlocking mechanism thereof is in an unlocking state and a child proof mechanism thereof is in a child unlocking state.

FIG. 16 is a side view of the main part of the rear side door's door lock apparatus when the locking and unlocking mechanism is in the unlocking state and the child proof mechanism is in a child locking state.

FIG. 17 is a block diagram of a control circuit.

FIG. 18 is a plan view showing authenticating areas of transmitters situated outside the motor vehicle.

FIG. 19 is a plan view showing authenticating areas of transmitters situated inside the motor vehicle.

FIG. 20 is an explanatory chart showing relationships between electric operation elements and switches of the front side door.

FIG. 21 is an explanatory chart showing relationships between electric operation elements and switches of the rear side door.

DESCRIPTION OF EMBODIMENTS

As shown in FIG. 1, a front side door FD of a motor vehicle V of a four-door sedan type has disposed therein or thereon a front side door's door lock apparatus 1F for holding the front side door FD in a closed position, an outside operation switch SW1 that is an outside electric operation element provided outside the vehicle, an inside handle IH that is an inside mechanical operation element and an inside operation switch SW2 that is an inside electric operation element both of which are provided inside the vehicle, a key cylinder KC for selectively switching a locking and unlocking mechanism, which will be described later, of the door lock apparatus 1F between a locking state and an unlocking state from the outside of the vehicle, and a lock knob (whose illustration is omitted) for selectively switching the locking and unlocking mechanism between the locking state and the unlocking state from the inside of the vehicle.

A rear side door RD has disposed therein or thereon a rear side door's door lock apparatus 1R for holding the rear side door RD in a closed position, an outside operation switch SW3 that is an outside electric operation element provided outside the vehicle, an inside handle IH that is an inside mechanical operation element and an inside operation switch SW4 that is an inside electric operation element both of which are provided inside the vehicle, and a lock knob (whose illustration is omitted) for selectively switching a locking and unlocking mechanism of the rear side door's door lock apparatus 1R between a locking state and an unlocking state from the inside of the vehicle. It should be noted that there may be a case where the lock knobs of the front side door FD and the rear side door RD are omitted depending on a specification of the motor vehicle.

A cancellation switch SW5 and an inside locking and unlocking operation switch SW11 are provided at a location (for example, a location situated near a driver's seat inside a passenger compartment or a location situated on an inner surface of the front side door FD) where a driver in the driver's seat can operate the switches. The cancellation switch SW5 is configured to enable or disable operations of inside operation switches SW2, SW4 in the other remaining side doors other than the front side door for the driver's seat. In particular, the cancellation switch SW5 is configured to make the operations of the inside operation switches SW2, SW4 effective or ineffective. The inside locking and unlocking operation switch SW11 is configured to switch the locking and unlocking mechanisms of all the side doors between the locking state and the unlocking state altogether from the inside of the vehicle.

Outside gripping handles OH are provided on the front side door FD and the rear side door RD to be gripped on when the doors are opened from the outside of the vehicle. The outside operation switches SW1, SW3 are disposed on front surfaces of the outside gripping handles OH, respectively, as shown in FIG. 2, for example, or are disposed on rear surfaces of the outside gripping handles OH or in the vicinity thereof. The inside operation switches SW2, SW4 are disposed on front surfaces of the inside handles IH, respectively, as shown in FIG. 3, for example, or are disposed on rear surfaces of the inside handles IH or in the vicinity thereof. In this embodiment, the operation switches SW1 to SW4 are each made up of an electrostatic condenser type touch switch for detecting a touch of a finger of a user. However, the invention is not limited thereto, and hence, the operation switches SW1 to SW4 may each be configured as a proximity switch for detecting an approach of part of a human body. The inside handle IH is configured not only as the handle that is gripped on when the door is opened from the inside of the vehicle but also as a mechanical operation element that can release a meshing mechanism, which will be described later, of the door lock apparatus 1F or the door lock apparatus 1R, while the outside gripping handle OH does not function as a mechanical operation element for the meshing mechanism. Configuring the outside gripping handle OH appearing as part of an external appearance of the motor vehicle V purely as a handle enhances the degree of freedom in designing the external appearance of the motor vehicle V.

The outside operation switches SW1, SW3 are electrically controlled by a control unit ECU (Electronic Control Unit) that is mounted on the motor vehicle V. The control unit ECU enables an operation performed by a proper user (a driver) who carries a transmitter (or an electronic key) SW6 provided exclusively for the motor vehicle when the control unit ECU verifies that the proper user has approached the motor vehicle V as a result of the proper user approaching to enter a predetermined area relative to the motor vehicle V and an ID signal sent and received being collated to be found identical with a proper ID signal through a radio communication between the transmitter SW6 and one of outside receivers R1 disposed on outer sides of a vehicle body.

In addition to the outside receivers R1, inside receivers R2 are provided on the motor vehicle V so as to be disposed inside the passenger compartment. The outside receivers R1 can receive a signal from the transmitter SW6 that is situated in predetermined areas outside the vehicle, and the inside receivers R2 can receive a signal from the transmitter SW6 that is situated inside the vehicle.

The transmitter SW6 is incorporated in a portable operation switch SW10 for radio communication that is an outside electric operation element carried by the user or is configured as a separate device from the portable operation switch SW10. The portable operation switch SW10 has an opening switching module operated to open the corresponding door and a locking and unlocking switching module operated when switching modes of the locking and unlocking mechanism. The opening switching module is allocated to each door, and the locking and unlocking switching module is used commonly for all the doors. The operations of the opening switching module and the locking and unlocking switching module are made enabled when the ID signal of the transmitter SW6 is authenticated and disabled when the ID signal of the transmitter SW6 is not authenticated.

FIG. 4 is an external perspective view of the door lock apparatus 1F, FIG. 5 is a partially exploded perspective view of the door lock apparatus 1F, FIG. 6 is an exploded perspective view of the door lock apparatus 1F, FIG. 7 is a rear view of the door lock apparatus 1F, and FIGS. 8 to 13 are explanatory drawings illustrating operations of a main part of the door lock apparatus 1F.

Directions used in the following description denotes directions resulting when the door lock apparatuses 1F, 1R are mounted in the doors.

The door lock apparatus 1F includes a meshing unit 2 mounted within the front side door FD and having a meshing mechanism for holding the front side door FD in a closed position by being brought into meshing engagement with a striker S provided on a vehicle body side and an operation unit 3 having a locking and unlocking mechanism made up of mechanical elements (a lever, a link and the like) enabling the front side door FD to be selectively switched to a locked state or an unlocked state.

As shown in, for example, FIG. 7, the meshing unit 2 has, as main constituent elements, a body 4 that is fixed to a rear end portion of the front side door FD inside the same door with a plurality of bolts (whose illustration is omitted), a meshing mechanism (with no reference numeral) accommodated within the body 4 and including a latch 5 capable of meshing with the striker S fixed to the vehicle body side and a ratchet 6 capable of engaging with the latch 5, and an opening lever 7 (refer to, for example, FIG. 6) capable of performing a releasing operation in a direction in which an engagement relationship of the ratchet 6 with the latch 5 is released.

The latch 5 is rotatably supported by a latch shaft 8 directed to extend in a front and rear direction within the body 4 and has a full latch engaging portion 51 and a half latch engaging portion 52 with both of which the ratchet 6 can engage and a meshing groove 53 capable of meshing with the striker S that enters a striker entrance groove 41 provided in the body 4.

As shown in FIG. 7, the striker entrance groove 41 in the body 4 is provided slightly upwards of a substantially central portion of the body 4 in an up and down or vertical direction and is shaped so that the groove extends towards the outside of the vehicle while being opened to the inside of the vehicle at an inboard end thereof. A reference sign or character "X" shown in FIG. 7 denotes a striker entrance line that is a striker entrance path along which the striker S enters the striker entrance groove 41 to be brought into meshing engagement with the meshing groove 53 when the front side door FD is closed.

In addition, as the front side door FD is closed, the latch 5 rotates through a predetermined angle in a counterclockwise direction against a biasing force of a spring (whose illustration is omitted) from an open position (a position situated substantially 90 degrees away from a position shown in FIG. 7 in a clockwise direction) that corresponds to an open state of the front side door FD where the front side door FD does not mesh with the striker S to arrive at a full latching position (the position shown in FIG. 7) that corresponds to a fully closed state of the front side door FD where the meshing groove 53 meshes with the striker S that enters the striker entrance groove 41 from the left in FIG. 7 along the striker entrance line X after passing a half latching position that corresponds to a half closed state of the front side door FD where the meshing groove 53 slightly meshes with the striker S. On the contrary, the latch 5 rotates reversely as the striker S withdraws from the striker entrance groove 41 as a result of the front side door FD being opened.

The ratchet 6 is situated below the striker entrance groove 41 and is rotatably supported by a ratchet shaft 9 directed to extend in the front and rear direction within the body 4. The ratchet 6 is biased in an engaging direction (in a counterclockwise direction in FIG. 7 in which the ratchet 6 engages with either of the full latch engaging portion 51 and the half latch engaging portion 52 of the latch 5) by a spring to be brought into engagement with the full latch engaging portion 51 to thereby hold the front side door FD in the fully closed state and to be brought into engagement with the half latch engaging portion 52 to thereby hold the front side door FD in the half closed state.

As shown in FIG. 6, the opening lever 7 is rotatably supported on a front surface side of the body 4 and coaxially with the ratchet 6 (which is shown in FIG. 7) so as to rotate together with the ratchet 6 and perform the releasing operation (rotating in a counterclockwise direction in FIG. 6) to thereby release the engagement relationship between the ratchet 6 and the latch 5. A released portion 71 is provided at an end portion of the opening lever 7 that extends into the inside of the vehicle.

Next, the operation unit 3 will be described.

As shown in FIG. 6, the operation unit 3 has a first synthetic resin cover 10, having substantially an L-shape when seen from a top side thereof, that is fixed to the body 4 so as to cover a front surface of the body 4, a second synthetic resin cover 11 configured to close a side surface of the first cover 10 that faces the inside of the vehicle, a synthetic resin waterproof side cover 12 configured to close a substantially upper half portion of the second cover 11 from the inside of the vehicle, a waterproof top cover 13 covering an upper mating surface between the first cover 10 and the second cover 11, and an operation mechanism (with no reference numeral) that is accommodated within an inside portion of a housing.

When referred to in this invention, the "inside portion of the housing" denotes an accommodating space defined between a side surface of the first cover 10 that is substantially at right angles to the front surface of the body 4 and a side surface of the second cover 11 that faces the side surface of the first cover 10.

The operation mechanism includes a locking and unlocking motor 14 as a drive source for the locking and unlocking mechanism, a locking and unlocking worm wheel 15 that can be driven to rotate backwards and forwards by the locking and unlocking motor 14, a locking lever 16 that can move to an unlocking position where a door opening operation of the inside handle IH is made enabled and a locking position where the door opening operation of the inside handle IH is made disabled, an opening link 18 that can move to an unlocking position and a locking position together with the locking lever 16 or as the locking lever 16 moves to the unlocking position and the locking position, an inside lever 19 that is linked with the inside handle IH, a key lever 20 that is coupled to the key cylinder KC, an arm 21 that supports the opening link 18, a releasing motor 22 as a drive source for an electric releasing mechanism, a releasing worm wheel 23 that can be driven to rotate by the releasing motor 22, an electric releasing lever 24 that performs a releasing operation (for example, a counterclockwise rotational operation in FIG. 8) as the releasing worm wheel 23 rotates, and a wiring plate 25 having applied thereto wiring that is electrically connected to the locking and unlocking motor 14, the releasing motor 22 and various types of switches. Additionally, a knob lever 17 is provided in an accommodating space defined between the second cover 11 and the waterproof side cover 12, and this knob lever 17 is linked with a lock knob for manual operation provided on an inner side of the front side door FD. It should be noted that in the case where the lock knob is omitted, the knob lever 17 is also omitted.

In this embodiment, the locking and unlocking mechanism includes the locking and unlocking motor 14 as the drive source therefor, the locking and unlocking worm wheel 15 that is a mechanical element, the locking lever 16 and the opening link 18.

Additionally, when referred to in the following description, an "unlocking state" denotes a state where the locking lever 16, the knob lever 17 and the opening link 18 take their unlocking positions, and a "locking state" denotes a state where the locking lever 16, the knob lever 17 and the opening link 18 take their locking positions. It should be noted that the configuration of the locking and unlocking mechanism is not limited to that of this embodiment, and hence, various modifications can be made thereto.

The electric releasing mechanism includes the releasing motor 22 as the drive source therefor, the releasing worm wheel 23 and the electric releasing lever 24.

The locking and unlocking motor 14 is accommodated in the housing, and a case thereof (a yoke) 14*a* is situated above the striker entrance line X shown in FIG. 7. The locking and unlocking motor 14 is disposed so that an output shaft 14*b* that is rotatably supported on the case 14*a* is directed downwards. Adopting this configuration can prevent rain water that enters from the striker entrance groove 41 from entering the inside of the case 14*a* of the locking and unlocking motor 14 to a maximum extent.

The wiring plate 25 has a coupler 251 that is formed integrally therewith and to which an outside connector (whose illustration is omitted) of an outside power supply that is connected to an onboard battery (whose illustration is omitted) and the control unit ECU. Additionally, the wiring plate 25 has the wiring that is applied to a side surface thereof that faces the outside of the vehicle. The wiring is used to supply electric power to the inside of the housing and output various signals therefrom. The wiring plate 25 is fixed in place inside the housing so as to cover the case 14*a* of the locking and unlocking motor 14 from the inside of the vehicle. The wiring of the wiring plate 25 is connected electrically to terminals of the locking and unlocking motor 14 and the releasing motor 22, as well as the outside connector that is connected to the coupler 251 such that the locking and unlocking motor 14 and the releasing motor 22 are controlled by the control unit ECU. It should be noted that the wiring plate 25 is omitted in FIG. 5 for the sake of clarity of an inside structure of the operation unit 3.

As shown in FIG. 8, the locking and unlocking worm wheel 15 is rotatably supported inside the housing by a shaft 26 that is situated below the case 14*a* of the locking and unlocking motor 14 so as to be directed to the inside and outside of the vehicle. Then, the locking and unlocking worm wheel 15 is brought into meshing engagement with a worm 141 that is securely fastened to the output shaft 14*b* of the locking and unlocking motor 14 so as to rotate from a neutral position (for example, a position shown in FIG. 8) in a clockwise direction or a counterclockwise direction against a biasing force of a spring 27 (refer to FIG. 6) that is wound around the shaft 26 as the locking and unlocking motor 14 is driven. Then, when the locking and unlocking motor 14 stops rotating, the locking and unlocking worm wheel 15 returns to the neutral position from the position to which it is rotated in the clockwise or counterclockwise direction by virtue of the biasing force of the spring 27.

The knob lever 17 is supported rotatably on a side surface of the second cover 11 by a shaft 111 provided on the second cover 11, and a coupling arm portion 171 that extends downwards is coupled to the manual operation lock knob via a coupling member 28 that is made up of a Bowden cable, whereby the knob lever 17 rotates, for example, to an unlocking position shown in FIG. 8 and a locking position shown in FIG. 9 that is situated a predetermined angle away in a counterclockwise direction from the unlocking position as the lock knob is operated to unlock and lock the door. An operation of the lock knob is transmitted to the locking lever 16 and the opening link 18 by way of the knob lever 17, as will be described later. When the lock knob is omitted, the coupling member 28 is also omitted.

The waterproof side cover 12 is fixed to an outer surface of the second cover 11 after the knob lever 17 is assembled to the second cover 11, whereby the waterproof side cover 12 closes part of the outer surface of the second cover 11 that includes an area where the knob lever 17 is placed to thereby prevent rain water from entering the inside of the housing.

The locking lever 16 is supported rotatably inside the housing by a shaft 101 that is provided on an inner surface of the first cover 10 so as to project towards the inside of the vehicle. In the locking lever 16, a toothed portion 161 that is formed on an obliquely front lower portion meshes with a toothed portion 151 provided on the locking and unlocking worm wheel 15, an upper portion is coupled to the key lever 20, and a coupling projecting portion 162 that is formed on an obliquely front upper portion passes through an arc hole 112 provided in the second cover 11 to be coupled to a coupling hole 172 in the knob lever 17. Further, an arm portion 164 is provided on the locking lever 16, and this arm portion 164 has a guide wall 165 extending downwards from the vicinity of a rotational center. The shaft 101, that is, the rotational center of the locking lever 16 is disposed so as to be situated above the striker entrance line X inside the housing.

By adopting this configuration, when the key lever 20 rotates based on an operation of the key cylinder KC, the knob lever 17 rotates based on an operation of the lock knob and the locking and unlocking worm wheel 15 rotates based on a driving of the locking and unlocking motor 14, the locking lever 16 can rotate to an unlocking position shown in FIG. 8 and a locking position shown in FIG. 9 that is a predetermined angle away in a clockwise direction from the unlocking position and is elastically held in the unlocking position and the locking position by virtue of an elastic holding force of a holding member 29. In the case where the locking and unlocking worm wheel 15 stays in the neutral position, the toothed portion 161 of the locking lever 16 is configured to stay in a non-meshing state relative to the toothed portion 151 of the locking and unlocking worm wheel 15. Due to this, a rotation of the locking lever 16 based on operations of the lock knob and the key cylinder KC is prevented from being transmitted to the locking and unlocking worm wheel 15.

The holding member 29 is made up of a torsion spring. In the holding member 29, a coil portion is supported on a cylindrical support portion 102 (refer to FIG. 6) that is formed integrally on the inner surface of the first cover 10, and both arm portions are placed so as to hold the coupling projecting portion 162 of the locking lever 16 therebetween. By adopting this configuration, when the locking lever 16 rotates from the unlocking position (or the locking position) to the locking position (or the unlocking position), a biasing direction of the locking lever 16 is changed from an unlocking direction (or a locking direction) to a locking direction (or an unlocking direction) substantially at a middle position between the unlocking position and the locking position as a boundary.

Stopping the locking lever 16 in the unlocking position and the locking position is executed as a result of part of the locking lever 16 being brought into abutment with a rubber stopper (whose illustration is omitted) fixed to the inner surface of the first cover 10.

A cam surface 163 is provided on an outer circumferential surface of the upper portion of the locking lever 16, and a detecting portion of a locking and unlocking state detecting switch SW7 that is assembled to the wiring plate 25 comes into contact with the cam surface 163. The locking and unlocking state detecting switch SW7 slides on and contacts relatively the cam surface 163 at the detecting portion as the locking lever 16 rotates and outputs a signal corresponding to an unlocking state or a locking state of the locking and unlocking mechanism. The signal so outputted is sent to the control unit ECU by way of the wiring plate 25.

The opening link 18 has a coupling hole 182 having an hourglass shape in a rotating portion 181 at a lower portion thereof. A plate-shaped coupling portion 211 that is provided at an inboard end portion of the arm 21 is inserted into the coupling hole 182, whereby the opening link 18 is coupled to the coupling portion 211 of the arm 21 so as to rotate a predetermined angle in the front and rear direction. Then, a coupling portion 183 provided at an upper portion is coupled to the arm portion 164 of the locking lever 16, as will be described later, whereby the opening link 18 rotates about the coupling portion 211 of the arm 21 to an unlocking position (a position shown in FIG. 8) and a locking position (a position shown in FIG. 9) that is situated a predetermined angle away in a counterclockwise direction from the unlocking position as the locking lever 16 rotationally moves to the unlocking position and the locking position.

Further, a releasing portion 184 is provided at a substantially central portion of the opening link 18 in the up and down or vertical direction, and when the opening link 18 stays in the unlocking position shown in FIG. 8, the releasing portion 184 can be brought into abutment with the released portion 71 of the opening lever 7 from therebelow. Additionally, a torsion spring 36 is placed on the rotating portion 181 of the opening link 18.

The torsion spring 36 is hooked on the opening link 18 at one end and the coupling portion 211 of the arm at the other end thereof to thereby apply a biasing force to the opening link 18 in the unlocking direction (a clockwise direction in FIG. 8) about the coupling portion 211 of the arm 21 at all times. The biasing force of the torsion spring 36 is set to be smaller than the holding force of the holding member 29 with which the locking lever 16 is elastically held in the locking position.

The coupling projecting portion 183 of the opening link 18 can slide in the vertical direction relative to the arm portion 164 of the locking lever 16 and is coupled to the arm portion 164 of the locking lever 16 in such a form that the coupling projecting portion 183 can be brought into abutment with the guide wall 165 only when the locking lever 16 rotates in the locking direction (a counterclockwise direction in FIG. 8).

By adopting this configuration, in the unlocking state shown in FIG. 8, when the locking lever 16 rotates to the locking position, the guide wall 165 of the locking lever 16 is brought into abutment with the coupling projecting portion 183 of the opening link 18, whereby the locking lever 16 rotates from the unlocking position to the locking position shown in FIG. 9. In addition, in the locking state shown in FIG. 9, when the locking lever 16 rotates to the unlocking position, the opening link 18 follows the rotation of the locking lever 16 to rotate from the locking position to the unlocking position shown in FIG. 8 by virtue of the biasing force of the torsion spring 36 without depending on the abutting relationship between the guide wall 165 and the coupling projecting portion 183.

In the locking state shown in FIG. 9, the biasing force of the torsion spring 36 is applied to the locking lever 16 in the unlocking direction (the clockwise direction). However, since the biasing force of the torsion spring 36 is smaller than the elastic folding force of the holding member 29 with which the locking lever 16 is held in the locking position, the locking lever 16 and the opening link 18 are prevented from being rotated to the unlocking positions by virtue of the biasing force of the torsion spring 36.

The arm 21 is supported rotatably so as to rotate in the vertical direction at a lower portion of a front surface of the body 4 by a shaft 31 that is directed to face the front and rear direction. Then, the coupling portion 211 of the inside of the vehicle is coupled to the opening link 18 as described above. The arm 21 rotates a predetermined angle in a releasing direction (a counterclockwise direction in FIG. 6) against a biasing force of a spring (whose illustration is omitted), and the opening link 18 is actuated to move upwards to perform a releasing operation.

The releasing motor 22 is disposed so that a case (a yoke) **22*a* thereof is situated below the striker entrance line X inside the housing and that an output shaft 22*b* that is rotatably supported on the case 22*a*** is directed obliquely downwards to the rear.

Disposing the releasing motor 22 below the striker entrance line X would cause fears that rain water entering from the striker entrance groove 41 may adhere to the releasing motor 22. However, since the releasing motor 22 is disposed so that the output shaft **22*b* is directed obliquely downwards to the rear, the entrance of rain water into the case 22*a*** can be suppressed to a minimum level.

The releasing worm wheel 23 has a circular disc shape and is supported rotatably on a shaft 39 that is directed to face the inside and outside of the vehicle inside the housing. The releasing worm wheel 23 meshes with a worm 221 that is securely fastened to the output shaft **22*b* that is supported rotatably on the case 22*a* of the releasing motor 22 and rotates a predetermined angle in a clockwise direction from a set portion (for example, a position shown in FIG. 8) against a biasing force of a spring 35 (refer to FIG. 6) that is wound around the shaft 39 as the releasing motor 22 is driven. Then, when the releasing motor 22 stops rotating after the releasing worm wheel 23 rotates to a position shown in FIG. 10, the releasing worm wheel 23 is caused to return to the set position from the position to which the releasing worm wheel 23 has rotated by the biasing force of the spring 35. Additionally, a cam surface 231 is provided on the releasing worm wheel 23, and this cam surface 231 has the shape of an involute curve in which a distance from a rotational center to an outer circumferential surface of the cam increases gradually in the counterclockwise direction in FIG. 8**.

The electric releasing lever 24 is supported rotatably by a shaft 103 at a central portion thereof in the front and rear direction inside the housing. The electric releasing lever 24 has a first arm portion 241 extending to the front and capable of sliding on and contacting the cam surface 231 of the releasing worm wheel 23 at a distal end portion and a second arm portion 242 extending to the rear and capable of being brought into abutment with the released portion 71 of the opening lever 7 from therebelow at a distal end portion.

For example, as shown in FIG. 8, when the releasing worm wheel 23 stays in the set position, the distal end portion of the first arm portion 241 of the electric releasing lever 24 is in abutment with a small diameter portion of the cam surface 231 of the releasing worm wheel 23, whereby the electric releasing lever 24 is held in the set position shown in FIG. 8. In this state, when the releasing worm wheel 23 rotates a predetermined angle from the set position shown in FIG. 8 in the clockwise direction to arrive at a releasing position shown in FIG. 10 based on a driving of the releasing motor 22, the distal end portion of the first arm portion 241 of the electric releasing lever 24 slides relatively on the cam surface 231 to be displaced to a large diameter portion of the cam surface 231, while the distal end portion of the second arm portion 242 is brought into abutment with the released portion 71 of the opening lever 7 from therebelow, causing the opening lever 7 to perform a releasing operation to release an engagement relationship between the latch 5 and the ratchet 6, thereby making it possible to open the front side door FD.

The inside lever 19 is supported rotatably by the shaft 103 that is concentric with the electric releasing lever 24 at a portion situated slightly below a central portion thereof in the vertical direction inside the housing and has a first arm portion 191, a second arm portion 192 and an unlocking operating portion 193. The first arm portion 191 extends upwards to project to the outside from an arc-shaped opening 113 (refer to FIG. 5) that is provided in the second cover 11. The second arm portion 192 extends obliquely downwards to the rear. The unlocking operating portion 193 is formed at an upper end portion of the first arm portion 191 and can be brought into abutment with one portion 173 of a lower part of the coupling arm portion 171 of the knob lever 17. An upper portion of the first arm portion 191 is coupled to the inside handle IH of the front side door FD by way of a coupling member 33 made up of a Bowden cable or the like, whereby as the inside handle IH is operated to open the door, the inside lever 19 rotates a predetermined angle in the counterclockwise direction from a set position shown in FIG. 8 against a biasing force of a spring 34 that is wound around the shaft 103 to thereby perform a releasing operation.

An abutment portion 192*a* is formed at a distal end portion of the second arm portion 192, and this abutment portion 192*a* can be brought into abutment with the rotating portion 181 of the opening link 18 from therebelow when the inside lever 19 performs the releasing operation.

The coupling member 33 is coupled to an upper portion of the first arm portion 191 of the inside lever 19 in such a way as to pass between the case 14*a* of the locking and unlocking motor 14 that is disposed at an upper portion inside the housing and the case 22*a* of the releasing motor 22 that is disposed at a lower portion inside the housing. This avoids a risk of the coupling member 33 overlapping the cases 14*a*, 22*a* that are thick in an inside and outside direction of the vehicle in relation to the same direction, thereby making it possible to reduce a thickness of the housing in relation to an inside direction of the vehicle.

Next, referring to FIGS. 14 to 16, the door lock apparatus 1R for the rear side door RD will be described.

The door lock apparatus 1R includes a meshing unit 2, whose illustration is omitted, having the same structure as that of the meshing unit 2 of the door lock apparatus 1F and an operation unit 3 whose configuration differs partially from the operation unit 3 of the door lock apparatus 1F. Consequently, the door lock apparatus 1R will be described only in relation to different features from the door lock apparatus 1F.

The door lock apparatus 1R has a first inside lever 19A and a second inside lever 19B in place of the inside lever 19 of the door lock apparatus 1F, and a child proof operation lever 19C and a connecting link 19D that constitute a child proof mechanism.

The first and second inside levers 19A, 19B are both supported rotatably on a shaft 103 that is concentric with an electric releasing lever 24.

The first inside lever 19A is coupled to the inside handle IH of the rear side door RD by way of a coupling member 33 at an upper end portion of a first arm portion 191A that extends upwards and performs a releasing operation in a counterclockwise direction from a set position shown in FIG. 15 as the inside handle IH is operated to open the door. Additionally, a control hole 195 having substantially an L shape when seen from a side thereof is provided in the first inside lever 19A.

The second inside lever 19B has a vertical elongated hole 196 that partially overlaps the control hole 195 in the first inside lever 19A and an abutment portion 192*a*B.

The child proof operation lever 19C is supported rotatably by a shaft 104 inside a housing and can rotate to a child proof unlocking position shown in FIG. 15 and a child proof locking position shown in FIG. 16 that is situated a predetermined angle in a counterclockwise direction away from the child proof unlocking position. An arc hole 197 directed to face the front and rear direction is provided at a front portion of the child proof operation lever 19C and an operation portion 198 projecting to the outside from a rear end face of the rear side door RD is provided at a rear portion of the child proof operation lever 19C.

In the connecting link 19D, an elongated hole 19Da provided in a vertically central portion engages with the shaft 103 so as to slide vertically, a lower projecting portion 19Db provided at a lower portion engages with the arc hole 197 in the child proof operation lever 19C so as to slide therein, and an upper projecting portion 19Dc provided at an upper portion engages with the control hole 195 and the elongated hole 196 so as to slide therein. In this configuration, when the child proof operation lever 19C stays in the child proof unlocking position shown in FIG. 15, the upper projecting portion 19Dc is in engagement with a narrow upper portion of the control hole 195, whereby the connecting link 19D is allowed to transmit the releasing operation of the first inside lever 19A to the second inside lever 19B. On the contrary, when the child proof operation lever 19C stays in the child proof locking position shown in FIG. 16, the upper projecting portion 19Dc stays in a wide lower portion of the control hole 195, whereby the connecting link 19D is prevented from transmitting the releasing operation of the first inside lever 19A to the second inside lever 19B.

Next, an electrical circuit including the control unit ECU according to this embodiment will be described.

As shown in FIG. 17, the control unit ECU is configured as an integral one-chip CPU together with a ROM that stores control programs and a RAM that functions as a working area for the CPU and executes a series of control processes using the control programs stored in the ROM. Additionally, the control unit ECU includes an authenticating module for collating an ID signal for a radio communication performed between the transmitter SW6 and the receivers R1, R2. The authenticating module may be separated from the control unit ECU.

The receivers R1, R2, the outside operation switches SW1, SW3 and the inside operation switches SW2, SW4 and the locking and unlocking state detecting switches SW7 of the individual doors, the cancellation switch SW5, child proof locking state detecting switches SW8 for detecting states of the child proof mechanisms, a vehicle speed sensor SW9 for detecting a vehicle speed, and the inside locking and unlocking operation switch SW11 are each electrically connected to an input port of the control unit ECU. Additionally, the locking and unlocking motors 14 and releasing motors 22 of the individual doors are electrically connected to an output port of the control unit ECU.

The cancellation switch SW5 is used when switching between an unsetting state where the operations of the inside operation switches SW2, SW4 that are provided in the other side doors than the front side door FD of the driver's seat are made enabled and a canceling state where the operations of the same inside operation switches SW2, SW4 are made disabled. Receiving an unsetting signal from the cancellation switch SW5, the control unit ECU holds the cancellation switch SW5 in the unsetting state where the operations of the inside operation switches SW2, SW4 are made enabled, whereas receiving a cancellation signal from the cancellation switch SW5, the control unit ECU holds the cancellation switch SW5 in the canceling state where the operations of the inside operation switches SW2, SW4 are made disabled.

The locking and unlocking state detecting switch SW7 detects a state of the locking and unlocking mechanism. Then, the locking and unlocking state detecting switch SW7 outputs an unlocking signal to the control unit ECU when detecting an unlocking state whereas the locking and unlocking state detecting switch SW7 outputs a locking signal to the control unit ECU when detecting a locking state.

The child proof locking state detecting switch SW8 detects a state of the child proof mechanism. The child proof locking state detecting switch SW8 sends a child proof unlocking signal to the control unit ECU when detecting a child proof unlocking state whereas the child proof locking state detecting switch SW8 sends a child proof locking signal to the control unit ECU when detecting a child proof locking state.

The vehicle speed sensor SW9 is used to detect whether the motor vehicle is at a halt or is running. The vehicle speed sensor SW9 sends a halt signal to the control unit ECU when detecting a halt or a speed equal to or slower than a predetermined speed set in advance and sends a running signal to the control unit ECU when detecting a speed faster than the predetermined speed.

The inside locking and unlocking operation switch SW11 is provided inside the vehicle and sends an unlocking signal to the control unit ECU when an unlocking operation is performed while sending a locking signal to the control unit ECU when a locking operation is performed. When receiving the unlocking signal, the control unit ECU controls the locking and unlocking motor 14 to perform an unlocking operation to switch the locking and unlocking mechanism to the unlocking state, whereas when receiving the locking signal, the control unit ECU controls the locking and unlocking motor 14 to perform a locking operation to switch the locking and unlocking mechanism to the locking state.

FIG. 18 is a plan view showing authenticating areas of the transmitter SW6 carried outside the vehicle, and FIG. 19 is a plan view showing authenticating areas of the transmitter SW6 carried or left inside the vehicle.

The outside receivers R1 are disposed so as to receive a signal from the transmitter SW6 when the transmitter SW6 exists in predetermined areas outside the vehicle. In the example shown in FIG. 18, the outside receivers R1 are disposed individually on front side doors FD on a driver's seat side and a front passenger's seat side. Then, an area OA1 situated adjacent to the front side door FD on the driver's seat side and an area OA2 situated adjacent to the front side door FD on the front passenger's seat side are set as areas where a signal from the transmitter SW6 carried outside the vehicle can be received by the outside receivers R1. In the case where the transmitter SW6 is carried or disposed inside either the area OA1 or the area OA2 and an ID signal sent and received is collated to be found identical with a proper ID signal set in advance through a radio communication performed between the outside receiver R1 corresponding to the relevant area and the transmitter SW6, the control unit ECU authenticates the transmitter SW6 and verifies that a proper user has approached the motor vehicle V.

Further, in the case where the outside receiver R1 that collates the ID signal is the outside receiver R1 that corresponds to the area OA1 on the driver's seat side, the control unit ECU authenticates the transmitter SW6 in association with the front side door FD on the driver's seat side, whereas in the case where the outside receiver R1 that collates the ID signal is the outside receiver R1 that corresponds to the area OA2 on the front passenger's seat side, the control unit ECU authenticates the transmitter SW6 in association with the front side door FD on the front passenger's seat side.

Setting of the areas where the signal from the transmitter SW6 carried outside the vehicle can be received by the outside receivers R1 is not limited the example shown in FIG. 18. For example, only the area OA1 that is situated adjacent to the front side door FD on the driver's seat side may be set as the area where the signal from the transmitter SW6 carried outside the vehicle can be received.

Similarly, the inside receivers R2 are also disposed to be scattered inside the vehicle so as to receive the signal from the transmitter SW6 carried or left in predetermined areas inside the vehicle. In the example shown in FIG. 19, the inside receivers R2 are disposed to be scattered in a passenger compartment and a luggage compartment, and one area IA expanding widely from an area situated adjacent to the front side door FD on the driver's seat side to the passenger compartment and the luggage compartment is set as an area where the signal from the transmitter SW6 can be received. In the case where the transmitter SW6 is disposed inside the area IA and the signal from the transmitter SW6 is collated to be found identical with the proper ID signal set in advance through a radio communication performed between the inside receivers R2 and the transmitter SW6, the control unit ECU authenticates the transmitter SW6 in association with the front side door FD on the driver's seat side.

Setting of the area where the signal from the transmitter SW6 carried or left inside the vehicle can be received by the inside receivers is also not limited to the example shown in FIG. 19. For example, a setting may be adopted in which the passenger compartment and the luggage compartment are divided into an area situated adjacent to the front side door FD on the driver's seat side and an area situated adjacent to the front side door FD on the front passenger's seat side and the transmitter SW6 is authenticated in association with either of the front side door FD on the driver's seat side and the front side door FD on the front passenger's seat side.

The control unit ECU receives respective signals from the transmitter SW6, the canceling switch SW5, the locking and unlocking state detecting switches SW7, the child proof locking state detecting switches SW8 and the vehicle speed sensor SW9 and performs the switching control to make the door opening operations of the operation switches SW1 to SW4 and the portable operation switch SW10 enabled or disabled according to the receiving conditions then. When receiving door opening operation signals from the operation switches SW1 to SW4 and the portable operation switch SW10 that are made enabled, the control unit ECU controls so that the releasing motor 22 in the side door that is attempted to be opened is driven to release the relevant side door from the locked state.

The control unit ECU performs switching controls for the front side door FD and the rear side door RD as illustrated in FIGS. 20 and 21, respectively.

In rows of "transmitter SW6" illustrated in FIGS. 20, 21, "Authenticated (Outside Vehicle)" denotes a case where the user who carries the transmitter SW6 stays in the predetermined area outside the vehicle and the transmitter SW6 is authenticated as a result of a collation of the ID signal performed between the outside receiver R1 and the transmitter SW6 finding that the ID signal is identical with the proper ID signal set in advance. On the other hand, "Not Authenticated" denotes a case where the transmitter SW6 is not authenticated as a result of the transmitter SW6 staying out of the predetermined areas set outside the vehicle and inside the vehicle. In addition, "authenticated (Inside Vehicle)" denotes a case where the transmitter SW6 is carried or left inside the vehicle, that is, the user is sitting inside the vehicle and the transmitter SW6 is authenticated as a result of a collation of the ID signal performed between the inside receivers R2 and the transmitter SW6 finding that the ID signal is identical with the proper ID signal set in advance.

Then, referring to FIGS. 20 and 21, the switching control will be described. The control unit ECU will perform, for example, the following switching control. Here, let's assume that the transmitter SW6 is authenticated in association with the front side door FD on the driver's seat side in the "Authenticated (Outside Vehicle)" and "Authenticated (Inside Vehicle".

<Front Side Doors FD>

As can be understood from FIG. 20, in a state where the transmitter SW6 is "Authenticated (Outside Vehicle)," operations of the outside operation switch SW1 and the inside operation switch SW2 in the driver's seat side front side door and the portable operation switch SW10 are made enabled irrespective of an operation of the canceling switch SW5 and what the locking and unlocking state detecting switch SW7 detects, provided that the vehicle speed sensor SW9 detects a halt of the motor vehicle V. On the other hand, an operation of the outside operation switch SW1 in the front passenger's seat side front side door is made enabled, provided that the vehicle speed sensor SW9 detects a halt of the motor vehicle V and the locking and unlocking state detecting switch SW7 detects an unlocking state, whereas in the case where the locking and unlocking state detecting switch SW7 detects a locking state, the operation of the outside operation switch SW1 is made disabled irrespective of the vehicle speed sensor SW9 detecting a halt of the motor vehicle V. In addition, an operation of the inside operation switch SW2 in the front passenger's seat side front side door is made disabled even though the vehicle speed sensor SW9 outputs a halt signal in the case where a canceling state is held as a result of the canceling switch SW5 performing a canceling operation or in the case where the locking and unlocking state detecting switch SW7 detects a locking state.

In a state where the transmitter SW6 is "Not Authenticated," in the case where an unsetting state is held as a result of the canceling switch SW5 being operated, operations of the inside operations switches SW2 in the driver's seat side and front passenger's seat side front side doors are made enabled, provided that the vehicle speed sensor SW9 outputs a halt signal. All the other operations than these operations are made disabled. By adopting this configuration, even in the case where the proper user does not sit in the motor vehicle V, the front seat passenger can open the corresponding front side door FD quickly by operating the inside operation switch SW2, thereby making it possible to prevent the front seat passenger from being left confined inside the vehicle. From the security point of view, operations of all the inside operation switches SW2 including operations of the inside operation switches SW2 in the driver's seat and front passenger's seat side front side doors may be made disabled, provided that the unsetting state is held as a result of the canceling switch SW5 being operated.

In a state where the transmitter SW6 is "Authenticated (Inside Vehicle)," operations of the outside operation switches SW1 in the driver's seat and front passenger's seat side front doors are made enabled, provided that the locking and unlocking state detecting switches SW7 detect an unlocking state, whereas the operations are made disabled, provided that the locking and unlocking state detecting switches SW7 detect a locking state. By adopting this configuration, when the user remains inside the vehicle, there is caused no fear of the front side door being opened abruptly by an unknown person from the outside of the vehicle. In addition, the operation of the inside operation switch SW2 in the driver's seat side front side door is made enabled, provided that the vehicle speed sensor SW9 detects a halt of the motor vehicle V, irrespective of the operation of the canceling switch SW5 and what the locking and unlocking state detecting switch SW7 detects. However, the operation of the inside operation switch SW2 in the front seat passenger's seat side front side door is made enabled, provided that the vehicle speed sensor SW9 detects a halt of the motor vehicle V, the locking and unlocking state detecting switch SW7 detects an unlocking state and an unsetting state is held as a result of the canceling switch SW5 being operated, whereas the operation of the inside operation switch SW2 in the front seat passenger's seat side front side door is made disabled in the case where the locking and unlocking state detecting switch SW7 detects a locking state or a canceling state is held as a result of the canceling switch SW5 being operated, irrespective of the vehicle speed sensor SW9 detecting a halt of the motor vehicle V.

<Rear Side Doors RD>

As can be understood from FIG. 21, in a state where the transmitter SW6 is "Authenticated (Outside Vehicle)," an operation of the portable operation switch SW10 is made enabled irrespective of an operation of the canceling switch SW5 and what the locking and unlocking state detecting switch SW7 and the child proof locking state detecting switch SW8 detect, provided that the vehicle speed sensor SW9 detects a halt of the motor vehicle V. On the other hand, an operation of the outside operation switch SW3 is made enabled, provided that the vehicle speed sensor SW9 detects a halt of the motor vehicle V and the locking and unlocking state detecting switch SW7 detects an unlocking state, irrespective of an operation of the canceling switch SW5 and what the child proof locking state detecting switch SW8 detects, whereas in the case where the locking and unlocking state detecting switch SW7 detects a locking state, the operation of the outside operation switch SW3 is made disabled irrespective of the vehicle speed sensor SW9 detecting a halt of the motor vehicle V, in the case where the locking and unlocking state detecting switch SW7 detects a locking state. In addition, an operation of the inside operation switch SW4 is made enabled, provided that the vehicle speed sensor SW9 detects a halt of the motor vehicle V, additionally, the locking and unlocking state detecting switch SW7 detects an unlocking state, further, an unsetting state is held as a result of the canceling switch SW5 being operated, and furthermore, the child proof locking state detecting switch SW8 detects a child proof unlocking state, whereas the operation of the inside operation switch SW4 is made disabled in the case where the locking and unlocking state detecting switch SW7 detects a locking state or a canceling state is held as a result of the canceling switch SW5 being operated. In addition, the operation of the inside operation switch SW4 is also made disabled irrespective of what the vehicle speed sensor SW9 detects, in the case where the child proof locking state detecting switch SW8 detects a child proof locking state. This can prevent an erroneous operation of the inside operation switch SW4 by a child or the like.

In a state where the transmitter SW6 is "Not Authenticated," in the case where an unsetting state is held as a result of the canceling switch SW5 being operated, an operation of the inside operations switch SW4 is made enabled only when the vehicle speed sensor SW9 outputs a halt signal. All the other operations than this operation are made disabled. By adopting this configuration, even in the case where the proper user does not sit in the motor vehicle V, a rear seat passenger can open the corresponding rear side door RD quickly by operating the inside operation switch SW4, thereby making it possible to prevent the rear seat passenger from being left confined inside the vehicle. From the security point of view, operations of all the inside operation switches including operations of the inside operation switches SW4 may be made disabled, in the case where the unsetting state is held as a result of the canceling switch SW5 being operated.

In a state where the transmitter SW6 is "Authenticated (Inside Vehicle)," operations of the outside operation switches SW3 are made enabled, in the case where the locking and unlocking state detecting switches SW7 detect an unlocking state, whereas the operations are made disabled, in the case where the locking and unlocking state detecting switches SW7 detect a locking state. By adopting this configuration, when the user remains inside the vehicle, there is caused no fear of the rear side door being opened abruptly by an unknown person from the outside of the vehicle. In addition, the operations of the inside operation switches SW4 are made enabled, provided that the vehicle speed sensor SW9 detects a halt of the motor vehicle V, additionally, the locking and unlocking state detecting switches SW7 detect an unlocking state, further, an unsetting state is held as a result of the canceling switch SW5 being operated, and furthermore, the child proof locking state detecting switches SW8 detect a child proof unlocking state, whereas the operations of the inside operation switches SW4 are made disabled irrespective of the vehicle speed sensor SW9 detecting a halt of the motor vehicle V in the case where the locking and unlocking state detecting switches SW7 detect a locking state, a canceling state is held by operation of the canceling switch SW5 being operated, or the child proof locking state detecting switches SW8 detect a child proof locking state.

Next, main operations of the door lock apparatuses 1F, 1R will be described.

Cases that will be described below are premised that the doors are closed, the control unit ECU authenticates the transmitter SW6 in association with the driver's seat side front side door FD, the vehicle speed sensor SW9 outputs a halt signal and an unsetting state is held as a result of the canceling switch SW5 being operated.

In the case where operations of the front side door FD are common to the rear side door RD, the operations of the front side door FD will be described as representing those of the rear side door RD.

<Case where Inside Handle IH is Operated with Locking and Unlocking Mechanism Staying in Unlocking State (for Front Side Door FD and Rear Side Door RD)>

With the locking and unlocking mechanism shown in FIG. 8 staying in the unlocking state, when the inside handle IH is operated to open the door, the door opening operation is transmitted to the inside lever 19 by way of the coupling member 33. The inside lever 19 performs a releasing operation to rotate a predetermined angle in the counterclockwise direction about the shaft 103 that is concentric with the electric releasing lever 24, whereby as shown in FIG. 12, the abutment portion 192*a* of the second arm portion 192 comes into abutment with the rotating portion 181 of the opening link 18 from therebelow to shift the opening link 18 upwards for releasing operation. As a result of the opening link 18 performing the releasing operation, the releasing portion 184 comes into abutment with the released portion 71 of the opening lever 7 from therebelow to thereby rotate the opening lever 7 in a releasing direction, whereby the meshing engagement of the meshing mechanism is released, thereby allowing the front side door FD to be opened.

<Case where Inside Handle IH is Operated with Locking and Unlocking Mechanism Staying in Locking State (for Front Side Door)>

In the locking state shown in FIG. 9, when the inside handle IH is operated to open the door, the inside lever 19 performs a releasing operation (rotates in the counterclockwise direction in FIG. 9) from the set position shown in FIG. 9 against the biasing force of the spring 34, whereby as shown in FIG. 13, the unlocking operating portion 193 of the inside lever 19 comes into abutment with the one portion 173 of the knob lever 17, whereby the locking lever 16 and the opening link 18 are shifted from the locking positions to the unlocking positions thereof.

As this occurs, the opening link 18 rotates in the unlocking direction together with the locking lever 16 while moving idly across in front of the released portion 71 of the opening lever 7 as the inside lever 19 performs the releasing operation. Thus, as shown in FIG. 13, since part of the opening link 18 comes into abutment with part of the opening lever 7 from a direction in which the opening link 18 cannot rotate the opening lever 7, the opening link 18 once stops before the unlocking position. Then, when the inside handle IH is once returned to an inoperable position, the opening link 18 moves downwards, and the part of the opening link 18 is disengaged from the part of the opening lever 7, whereby the opening link 18 is caused to move to the unlocking position by virtue of the biasing force of the torsion spring 36 and then arrives at the unlocking position. This switches the locking and unlocking mechanism to the unlocking state completely. Thereafter, when the inside handle IH is operated again to open the door, the meshing of the meshing mechanism can be released, thereby making it possible to open the front side door FD.

<Case where Locking and Unlocking Mechanism Stays in Unlocking State and Child Proof Mechanism Stays in Child Proof Unlocking State (for Rear Side Door RD)>

When referred to herein, the "child proof unlocking state" denotes a state where the child proof operation lever 19C stays in the child proof unlocking position, whereby an operation of the first inside lever 19A can be transmitted to the second inside lever 19B. The "child proof locking state" denotes a state where the child proof operation lever 19C stays in the child proof locking position, whereby an operation of the first inside lever 19A cannot be transmitted to the second inside lever 19B.

In the state shown in FIG. 15, when the inside handle IH is operated to open the door, the first inside lever 19A rotates about the shaft 103 the predetermined angle in the counterclockwise direction from the set portion. The rotation of the first inside lever 19A is transmitted to the second inside lever 19B by way of the connecting link 19D, whereby the second inside lever 19B rotates in the counterclockwise direction together with the first inside lever 19A to perform a releasing operation. This brings the abutment portion 192*a*B of the second inside lever 19B into abutment with the lower portion of the rotating portion 181 of the opening link 18 from therebelow to thereby move the opening link 18 upwards to perform a releasing operation. As a result of the opening link 18 performing the releasing operation, the releasing portion 184 is brought into abutment with the released portion 71 of the opening lever 7 from therebelow, whereby the opening lever 7 is caused to rotate in a releasing direction to release the meshing of the meshing mechanism, thereby making it possible to open the rear side door RD.

<Case where Locking and Unlocking Mechanism Stays in Unlocking State and Child Proof Mechanism Stays in Child Proof Locking State (for Rear Side Door RD)>

In the state shown in FIG. 16, even though the first inside lever 19A performs a releasing operation based on a door opening operation of the inside handle IH, the releasing operation is not transmitted to the second inside lever 19B, whereby the rear side door RD cannot be opened. Thus, in this state, the rear side door RD cannot be opened even though the inside handle IH is so operated from the inside of the vehicle.

<Case where Opening Switch Modules of Outside Operation Switches SW1, SW3 or Portable Operation Switch SW10 are Operated with Locking and Unlocking Mechanism Staying in Unlocking State (for Front Side Door FD and Rear Side Door RD)>

When receiving the door opening operation signal from any of the outside operation switches SW1, SW3 and the portable operation switch SW10, the control unit ECU controls to drive the releasing motor 22 of the door operated to be opened (the door whose outside operation switch SW1 or SW3 is operated or the door selected by the portable operation switch SW10) to activate a releasing operation so as to rotate the releasing worm wheel 23 of the relevant door from the set position in the releasing direction (for example, in the clockwise direction in FIG. 8). As this occurs, in the electric releasing lever 24, irrespective of the state of the locking and unlocking mechanism, the distal end portion of the first arm portion 241 slides on the cam surface 231 of the releasing worm wheel 23 and rotates from the set position to the releasing operating position (the position shown in FIG. 10 in the unlocking state, and the position shown in FIG. 11 in the locking state) as the releasing worm wheel 23 rotates in the releasing direction. Then, the distal end portion of the second arm portion 242 comes into abutment with the released portion 71 of the opening lever 7 from therebelow to cause the opening lever 7 to perform a releasing operation. This can release the meshing state of the meshing mechanism, whereby the door to be operated to open can be opened.

In this operation, the electric releasing lever 24 directly activates the opening lever 7 to perform the releasing operation irrespective of the state of the locking and unlocking mechanism, and therefore, even though the locking and unlocking mechanism is in the locking state, by operating the outside operation switch SW1 of the door to be operated to open once to open the relevant door, the door to be operated to open can be opened quickly by driving the releasing motor 22 thereof to activate the releasing operation.

<Case where Outside Operation Switch SW1 of Driver's Seat Side Front Side Door FD is Operated with Locking and Unlocking Mechanism Staying in Locking State>

With the transmitter SW6 carried outside the vehicle authenticated in association with the driver's seat side front side door FD, when receiving a door opening operation signal from the outside operation switch SW1 in the driver's seat side front side door FD, the control unit ECU controls to drive the releasing motor 22 in the driver's seat side front side door FD to activate a releasing operation. This activates the releasing operation irrespective of the state of the locking and unlocking mechanism in the driver's seat side front side door FD, whereby the driver's seat side front side door FD can be opened quickly by a single door opening operation of the outside operation switch SW1 in the driver's seat side front side door FD. Further, even though the inside locking and unlocking operation switch SW11 is operated substantially at the same time, causing a switching operation of the locking and unlocking mechanism from the locking state to the unlocking state and a releasing operation of the electric releasing lever 24 to overlap or concur with each other, an occurrence of a so-called panic phenomenon is prevented, thereby making it possible to switch the locking and unlocking mechanism to the unlocking state in an ensured fashion.

<Case where Outside Operation Switch SW1 in Front Passenger's Seat Side Front Side Door FD or Outside Operation Switch SW3 in Rear Side Door RD is Operated with Locking and Unlocking Mechanism Staying in Unlocking State>

With the transmitter SW6 carried outside of the vehicle authenticated in association with the driver's seat side front side door FD, when receiving a door opening operation signal from the outside operation switch SW1 in the front passenger's seat side front side door FD or the outside operation switch SW3 in the rear side door RD, the control unit ECU makes the operations of these outside operation switches SW1, SW3 disabled in such a state that the locking and unlocking mechanisms in the front passenger's seat side front side door FD and the rear side door RD are locked and does not control to drive the releasing motors 22 to activate a releasing operation.

However, when controlling to drive the releasing motor 22 in the driver's seat side front side door FD to activate a releasing operation based on the outside operation switch SW1 of the driver's seat side front side door FD, the control unit ECU also controls to drive the respective locking and unlocking motors 14 in the driver's seat side front side door FD, the front passenger's seat side front side door FD and the rear side doors RD to activate an unlocking operation to thereby switch the locking and unlocking mechanisms in these doors to the unlocking state. This enables operations of the outside operation switch SW1 of the front passenger's seat side front door FD whose locking and unlocking mechanism is switched to the unlocking state and the outside operation switches SW3 of the rear side doors RD whose locking and unlocking mechanisms are also switched to the unlocking state, whereby the front passenger's seat side front side door FD and the rear side doors RD can be opened when the outside operation switches SW1, SW3 are operated to open the corresponding doors.

In this way, the door (the driver's seat side front side door FD) associated with authentication of the transmitter SW6, that is, the door that the holder of the transmitter SW6 attempts to open is operated to be released irrespective of the state of the locking and unlocking mechanism thereof when the outside operation switch thereof is operated, while the other doors (the front passenger's seat side front door FD and the rear side doors RD) can be operated to be released when the outside operation switches thereof are operated only in such a state that the locking and unlocking mechanism is in the unlocking state, whereby the locking and unlocking mechanisms of the other doors are switched to the unlocking state as the door associated with authentication of the transmitter SW6 is operated to be released. This enables the passengers to be warned to pay attention to the safety of surroundings when they open the doors to get in the vehicle.

<Case where Inside Operation Switch SW2 or SW4 is Operated with Locking and Unlocking Mechanism Staying in Unlocking State (for Front Side Doors FD and Rear Side Doors RD)>

When receiving a door opening operation signal from the inside operation switch SW2 or SW4, the control unit ECU controls to drive the releasing motor 22 in the door to be operated to open to activate a releasing operation. This causes the electric releasing lever 24 to perform a releasing operation irrespective of the state of the locking and unlocking mechanism (the child proof mechanism is included in the case of the rear side doors), whereby the door to be operated to open can be opened quickly only by operating once the inside operation switch SW2 or SW4 to open the door.

In relation to the operation of the inside operation switches SW4 in the rear side doors RD, with the child proof mechanisms staying in the child proof locking state, the operations of the inside operation switches SW4 may be made disabled even though the locking and unlocking mechanisms stay in the unlocking state so that the releasing motors 22 in the rear side doors RD are not controlled to be driven to activate a releasing operation.

<Case where Inside Switch SW2 of Driver's Seat Side Front Side Door FD is Operated with Locking and Unlocking Mechanism Staying in Locking State>

With the transmitter SW6 carried or left inside the vehicle authenticated in association with the driver's seat side front side door FD, when receiving a door opening operation signal from the inside operation switch SW2 of the driver's seat side front side door FD, the control unit ECU controls to drive the releasing motor 22 in the driver's seat side front side door FD to activate a releasing operation. This enables a releasing operation irrespective of the state of the locking and unlocking mechanism of the driver's seat side front side door FD, and the driver's seat side front door FD can be opened quickly by operating once the inside operation switch SW2 of the driver's seat side front side door FD to open the door. Further, even though the inside handle IH is operated substantially at the same time, causing a switching operation of the locking and unlocking mechanism from the locking state to the unlocking state and a releasing operation of the electric releasing lever 24 to overlap or concur with each other, an occurrence of a so-called panic phenomenon is prevented.

<Case where Inside Operation Switch SW2 of Front Passenger's Seat Side Front Door FD or Inside Operation Switch SW4 of Rear Side Door RD is Operated with Locking and Unlocking Mechanism Staying in Locking State>

With the transmitter SW6 carried or left inside the vehicle authenticated in association with the driver's seat side front side door FD, when receiving a door opening operation signal from the inside operation switch SW2 of the driver's seat side front side door FD or the inside operation switch SW4 of the rear side door RD, the control unit ECU makes the operations of these inside operation switches SW2, SW4 disabled with the locking and unlocking mechanisms in the front passenger's seat side front door FD and the rear side doors RD staying in the locking state, so that the releasing motors 22 in these doors are not controlled to be driven to activate a releasing operation.

For example, as a result of the control unit ECU receiving an unlocking operation signal from the inside locking and unlocking operation switch SW11 that can be operated by the driver sitting in the driver's seat, the control unit ECU controls to drive the locking and unlocking motors 14 for an unlocking operation to thereby switch the locking and unlocking mechanisms of all the doors including the front passenger's seat side front door FD and the rear side doors RD to the unlocking state. This enables the operations of inside operation switch SW2 of the front passenger's seat side front side door FD and the inside operation switches SW4 of the rear side doors RD, whereby the front passenger's seat side front side door FD and the rear side doors RD can be opened when these inside operations switches SW2, SW4 are operated to open the corresponding doors. Alternatively a configuration may be adopted in which the locking and unlocking motors 14 of the respective locking and unlocking mechanisms of the driver's seat side front side door FD, the front passenger's seat side front side door FD and the rear side doors RD are also controlled to be driven to activate an unlocking operation when the releasing motor 22 of the driver's seat side front side door FD is driven to activate a releasing operation based on the inside operation switch SW2 of the driver's seat side front side door FD, so that the locking and unlocking mechanisms of these doors are switched to the unlocking state.

In this way, the door (the driver's seat side front side door FD) associated with authentication of the transmitter SW6, that is, the door that the holder of the transmitter SW6 attempts to open is operated to be released irrespective of the state of the locking and unlocking mechanism thereof when the inside operation switch thereof is operated, while the other doors (the front passenger's seat side front door FD and the rear side doors RD) can be operated to be released when the inside operation switches thereof are operated only in such a state that the locking and unlocking mechanism is in the unlocking state, whereby the passengers can be warned to pay attention to the safety of surroundings when opening the corresponding doors in the latter case.

Thus, while the embodiment of the invention has been described heretofore, the following various modifications, alterations or combinations thereof can be made to the embodiment described heretofore without departing from the spirit and scope of the invention.

(1) A sliding door that is supported on a lateral side of a vehicle body so as to be opened and closed in the front and rear direction is adopted as the door to which the door lock apparatus of the invention is applied.

(2) The door is electrically opened and closed by a door opening and closing apparatus using a motor or the like as a drive source. As this occurs, the door opening and closing apparatus is controlled to be driven to move the door in an opening direction after a meshing of a meshing mechanism is released based on a door opening operation of an electric operation element.

(3) When the vehicle speed sensor detects that the vehicle starts running from a halt state, the locking and unlocking motors 14 of the locking and unlocking mechanisms of all the doors are controlled to be driven to switch the locking and unlocking mechanisms to the locking state.

(4) Even in such a state that the authenticating module does not authenticate the ID signal, door opening operations of the outside operation switches SW1, SW3 of the doors that are unlocked are made enabled, so that the doors can be opened based on the door opening operations.

REFERENCE SIGNS LIST

1F, 1R Door lock apparatus
2 Meshing unit
3 Operation unit
4 Body
5 Latch (Meshing mechanism)
6 Ratchet (Meshing mechanism)
7 Opening lever
8 Latch shaft
9 Ratchet shaft
10 First cover
11 Second cover
12 Waterproof side cover
13 Waterproof top cover
14 Locking and unlocking motor
14*a* Case
14*b* Output shaft
15 Locking and unlocking worm wheel (Locking and unlocking mechanism)
16 Locking lever (Locking and unlocking mechanism)
17 Knob lever
18 Opening link (Locking and unlocking mechanism)
19 Inside lever
19A First inside lever
19B Second inside lever
19C Child proof operation lever
19D Connecting link
19Da Elongated hole
19Db Lower projecting portion
19Dc Upper projecting portion
20 Key lever
21 Arm
22 Releasing motor
22*a* Case
22*b* Output shaft
23 Releasing worm wheel (Electric releasing mechanism)
24 Electric releasing lever (Electric releasing mechanism)
25 Wiring plate
26 Shaft
27 Spring
28 Coupling member
29 Holding member
31 Shaft
33 Coupling member
34 Spring
35 Spring
36 Torsion spring
39 Shaft
41 Striker entrance groove
51 Full latch engaging portion
52 Half latch engaging portion
53 Meshing groove
71 Released portion
101 Shaft
102 Support portion
103, 104, 111 Shaft
112 Arc hole
113 Opening
141 Worm
151 Toothed portion
161 Toothed portion
162 Coupling projecting portion
163 Cam surface
164 Arm portion
165 Guide wall
171 Coupling arm portion
172 Coupling hole
173 One portion
181 Rotating portion
182 Coupling hole
183 Coupling projecting portion
184 Releasing portion
191, 191A First arm portion
192 Second arm portion
192*a*, 192*a*B Abutment portion
193 Unlocking operating portion
195 Control hole
196 Elongated hole
197 Arc hole
198 Operating portion
211 Coupling portion
221 Worm
231 Cam surface
241 First arm portion
242 Second arm portion
251 Coupler
ECU Control unit
FD Front side door
IH Inside handle (inside mechanical operation element)
KC Key cylinder
OH Outside handle
RD Rear side door
R1 Outside receiver
R2 Inside receiver
S Striker
SW1, SW3 Outside operation switch (Outside electric operation element)
SW2, SW4 Inside operation switch (Inside electric operation element)
SW5 Canceling switch
SW6 Transmitter
SW7 Locking and unlocking state detecting switch
SW8 Child proof locking state detecting switch
SW9 Vehicle speed sensor
SW10 Portable operation switch (Outside electric operation element)
SW11 Inside locking and unlocking operation switch
X Striker entrance line
V Motor vehicle.

The invention claimed is:

1. A motor vehicle door lock apparatus comprising:

a meshing mechanism configured to mesh with a striker to hold a door in a closed state;

an outside handle provided on an outer side of the door and not linked mechanically with the meshing mechanism;

an outside electric operation element provided on the outer side of the door;

an inside mechanical operation element provided on an inner side of the door;

a locking and unlocking mechanism configured to be selectively switched to:

an unlocking state where a meshing of the meshing mechanism can be released based on a door opening operation of the inside mechanical operation element; and a locking state where a meshing of the meshing mechanism cannot be released;

a control unit configured to authenticate a transmitter based on a signal emitted by the transmitter, wherein in a case where the transmitter is situated outside a vehicle, the control unit is configured to:

enable an operation of the outside electric operation element when the transmitter is authenticated; and disable the operation of the outside electric operation element when the transmitter is not authenticated;

an electric releasing mechanism configured to release a meshing of the meshing mechanism by the control unit driving a releasing motor to activate a releasing operation based on the operation of the outside electric operation element when the control unit authenticates the transmitter outside the vehicle, regardless of the locking and unlocking mechanism being in either the unlocking state or the locking state, an inside electric operation element provided on the inner side of the door, wherein in a case where the transmitter is situated inside the vehicle, the control unit is configured to:

enable an operation of the inside electric operation element when the transmitter is authenticated; and disable the operation of the inside electric operation element when the transmitter is not authenticated, and wherein the electric releasing mechanism is configured to release the meshing of the meshing mechanism by the control unit driving the releasing motor to activate the releasing operation based on the operation of the inside electric operation element when the control unit authenticates the transmitter inside the vehicle, regardless of the locking and unlocking mechanism being in either the unlocking state or the locking state.

2. The motor vehicle door lock apparatus according to claim 1, wherein in a case where the transmitter outside the vehicle is disposed within a predetermined area on the outer side of the door, the control unit is configured to authenticate the transmitter in association with the door and to drive the releasing motor to activate a releasing operation in relation to the electric releasing mechanism of the door associated with authentication of the transmitter outside the vehicle based on an operation of the outside electric operation element of the door.

3. The motor vehicle door lock apparatus according to claim 2, wherein when the control unit drives the releasing motor to activate the releasing operation in relation to the electric releasing mechanism of the door associated with the authentication of the transmitter outside the vehicle, the control unit is configured to drive a locking and unlocking motor of the locking and unlocking mechanism of the door associated with the authentication and locking and unlocking motors of locking and unlocking mechanisms of other doors to activate an unlocking operation, so as to switch the locking and unlocking mechanisms to an unlocking state.

4. The motor vehicle door lock apparatus according to claim 2, wherein in a case where locking and unlocking mechanisms of other doors other than the door associated with the authentication of the transmitter outside the vehicle stay in an unlocking state, the control unit is configured to drive the releasing motors to activate a releasing operation in relation to the electric releasing mechanisms of said other doors based on operations of the outside electric operation elements of said other doors.

5. The motor vehicle door lock apparatus according to claim 1, wherein in a case where the transmitter inside the vehicle is disposed within a predetermined area on the inner side of the door, the control unit is configured to authenticate the transmitter in association with the door and to drive the releasing motor to activate a releasing operation in relation to the electric releasing mechanism of the door associated with authentication of the transmitter inside the vehicle based on the operation of the inside electric operation element of the door.

6. The motor vehicle door lock apparatus according to claim 5, wherein in a case where locking and unlocking mechanisms of other doors other than the door associated with the authentication of the transmitter inside the vehicle stay in an unlocking state, the control unit is configured to drive the releasing motors to activate a releasing operation in relation to the electric releasing mechanisms of said other doors based on operations of the inside electric operation elements of said other doors.

7. The motor vehicle door lock apparatus according to claim 6, wherein in a case where the locking and unlocking mechanisms of said other doors other than the door associated with the authentication of the transmitter inside the vehicle stay in a locking state, the control unit is configured to disable operations of the inside electric operation elements of said other doors.

8. The motor vehicle door lock apparatus according to claim 1, further comprising:

a child proof mechanism configured to be switched to a child proof locking state where an operation of the inside mechanical operation element of one or more of the doors is disabled, wherein in a case where the child proof mechanism stays in the child proof locking state, the control unit is configured to disable the operation of the inside electric operation element of the door in which an operation of the inside mechanical operation element is disabled by the child proof mechanism.

9. The motor vehicle door lock apparatus according to claim 1, wherein in a case where a vehicle speed sensor detects that the vehicle is running, the control unit is configured to disable operations of the inside electric operation elements of all the doors.

10. The motor vehicle door lock apparatus according to claim 1, wherein in a case where a vehicle speed sensor detects that the vehicle starts running from a halt state, the control unit is configured to drive locking and unlocking motors of locking and unlocking mechanisms of all the doors to activate a locking operation so as to switch the locking and unlocking mechanisms to a locking state.

* * * * *